US008875920B2

(12) United States Patent
Farrar et al.

(10) Patent No.: US 8,875,920 B2
(45) Date of Patent: Nov. 4, 2014

(54) BEVERAGE CONTAINER INCLUDING A CAP AND COLLAR

(75) Inventors: Peter Antony Farrar, Menston (GB); John Hein, Menston (GB); Anthony Henry Joseph Fraser, Ketton (GB); William George Dando, Hartshorne (GB)

(73) Assignee: Threadless Closures Limited (GB)

( * ) Notice: Subject to any disclaimer, the term of this patent is extended or adjusted under 35 U.S.C. 154(b) by 2052 days.

(21) Appl. No.: 11/570,633

(22) PCT Filed: Jun. 23, 2005

(86) PCT No.: PCT/GB2005/002471

§ 371 (c)(1),
(2), (4) Date: Jun. 24, 2008

(87) PCT Pub. No.: WO2006/000774

PCT Pub. Date: Jan. 5, 2006

(65) Prior Publication Data

US 2008/0257848 A1 Oct. 23, 2008

(30) Foreign Application Priority Data

Jun. 23, 2004 (GB) ..... 0414065.3
Mar. 23, 2005 (GB) ..... 0505934.0

(51) Int. Cl.

| | |
|---|---|
| ***B65D 41/00*** | (2006.01) |
| ***B65D 41/06*** | (2006.01) |
| ***B65D 41/08*** | (2006.01) |

(52) U.S. Cl.

CPC ..... *B65D 41/065* (2013.01); *B65D 41/06* (2013.01); *B65D 41/086* (2013.01); *B65D 41/08* (2013.01)

USPC ..... 215/329; 215/44; 220/252

(58) Field of Classification Search

USPC ..... 214/44, 335, 329, 274, 334, 296; 220/319; 215/252

See application file for complete search history.

(56) References Cited

U.S. PATENT DOCUMENTS 5,103,991 A * 4/1992 Collins ..... 215/329
5,197,617 A * 3/1993 Edwards ..... 215/221
5,813,553 A * 9/1998 Herr et al. ..... 215/252

FOREIGN PATENT DOCUMENTS

GB 735963 * 8/1955

* cited by examiner

*Primary Examiner* — Anthony Stashick
*Assistant Examiner* — Raven Collins
(74) *Attorney, Agent, or Firm* — Quarles & Brady LLP

(57) ABSTRACT

A beverage container (1) comprises a container body (3) including an opening, a cap (5) to close the opening, and a collar (7), mountable on the container body (3). The cap (5) and the collar (7) include cooperating securement means (19, 21) by which the cap (5) may be secured to the collar (7), thereby securing the cap (5) to the container body (3) when the collar (7) is mounted on the container body (3). The cap (5), the collar (7) and the container body (3) are configured such that removal of the cap (5) from the container body (3) causes removal of the collar (7) from the container body (3).

18 Claims, 18 Drawing Sheets

BEVERAGE CONTAINER INCLUDING A CAP AND COLLAR

TECHNICAL FIELD

The present invention relates to beverage containers, and particularly relates to containers for supplying beverages to consumers. The invention has particular utility for the storage and supply of carbonated and other sparkling drinks, but is also suitable for use with other types of drinks.

BACKGROUND ART

Containers that have a separate ring or collar carrying a screw thread for securing a cap to the container, are known from U.S. Pat. Nos. 3,603,472 and 4,576,296, International Patent Application WO 84/01763, and European Patent Application EP 0517676, for example.

SUMMARY OF INVENTION

The present invention seeks to provide an improved beverage container, at least some embodiments of which include a separate ring or collar enabling the securement of a cap to the body of the container.

A first aspect of the present invention provides a beverage container comprising a container body including an opening, a cap to close the opening, and a part, preferably a collar, mountable on the container body, the cap and the collar including cooperating securement means by which the cap may be secured to the collar, thereby securing the cap to the container body when the collar is mounted on the container body. Preferably the cap, the collar (or other part), and the container body are configured such that removal of the cap from the container body causes or allows removal of the collar from the container body.

A second aspect of the invention provides a beverage container comprising a container body including an opening which defines an axis extending therethrough, and closure means to close the opening, the closure means comprising first and second parts adapted to be connected to each other so as to be moveable relative to each other in the direction of the axis, whereby at least the first part of the closure means is brought into secure engagement with the container body. Preferably the first part of the closure means comprises a cap. Preferably the second part of the closure means comprises a collar. The collar preferably is removable from the container body.

An advantage of the invention is that by providing a collar on a beverage container body, to which a cap may be secured in order to close the container, which collar preferably may be removed from the container body, enables the container body to be free from exterior threads or other securement means for securing the cap thereto. Providing a beverage container that is free from exterior threads or other securement means enables the provision of a truly practical beverage container from which consumers may drink directly. This is because the presence of threads adjacent to the opening is a major reason for bottles and known wide-mouth containers being impractical as truly acceptable drinking vessels for consumers.

For the avoidance of doubt, it is to be understood that the term "collar" as used in this specification does not include known cap-like parts that extend across openings in containers.

Other advantages that the present invention can (at least in some embodiments) provide, include the following:

De-coupling the method of securing the cap to the container body (i.e. via the collar) from any method of sealing the container (e.g. via a seal provided between the cap and the container body). This is to be contrasted from known containers in which an inner cap-like part both provides a seal against the container body and contributes to the securing of an outer cap to the container body, for example. Such de-coupling can often provide both better sealing and better securement.

The placing of the means of securing the cap to the container body (i.e. the collar, or parts (e.g. flaps) of the collar) under compression (between part of the cap and part of the container body) rather than under tension. This is to be contrasted from known containers in which an inner cap-like part contributes to the securing of an outer cap to the container body, via parts of the inner cap-like part that are placed under tension. The placing of securing parts under compression rather than under tension can often provide stronger securement.

Preferably, the container body of the invention includes one or more retaining parts by which the collar is retained on the container body until removal of the cap causes the collar to be removed or removable from the container body. Advantageously, the retaining part may be a rim of the container body, preferably a radially-outwardly projecting rim. Preferably, the collar is retained on the container body by being trapped beneath the rim or other retaining part of the container body. Additionally or alternatively, the (or each) retaining part may be a recess (e.g. a depression or indentation) in a surface, preferably an exterior surface, of the container body (e.g. in a rim of the container body, optionally at the lower edge thereof) of the container body. For example, the container body may be provided with one or more recesses provided around the exterior circumference of the container body. Preferably the collar engages with the one or more retaining parts to retain the collar on the container body in use.

Accordingly, a third aspect of the invention provides a beverage container comprising a container body including an opening and a cap to close the opening, the container body including a plurality of recesses in an exterior surface of the container body with which the cap may directly or indirectly engage, to secure the cap to the container body. If the container body has a projecting rim, the plurality of recesses may, for example, be provided in the projecting rim. Preferably the beverage container includes at least one part, preferably a collar, which is engageable with the recesses and to which the cap may be secured, thereby securing the cap indirectly to the container body. Preferably the recesses are provided spaced-apart around a circumference of the exterior surface of the container body (e.g. at the lower edge of a projecting rim of the container body).

A fourth aspect of the invention provides a beverage container comprising a container body including an opening, a cap to close the opening, and a part, preferably a collar, engageable with the container body, the cap and the collar including cooperating securement means by which the cap may be secured to the collar, thereby securing the cap to the container body when the collar is engaged with the container body. Preferably the cap, the collar (or other part), and the container body are configured such that movement of the cap with respect to the collar and/or the container body causes or allows disengagement of the collar from the container body.

Preferably, such movement of the cap with respect to the collar (or other part) and/or the container body that causes or allows disengagement of the collar from the container body comprises rotation (e.g. an unscrewing rotation) of the cap with respect to the collar and/or the container body. For example, an initial movement of the cap with respect to the collar may allow a continued or subsequent movement of the cap to cause the cap and the collar both to move with respect to the container body. Even more preferably, such movement of the cap and the collar with respect to the container body causes or allows one or more parts of the collar to move outwards (e.g. radially outwards) with respect to the container body, thereby disengaging the collar from the container body. Once the collar is disengaged from the container body, preferably the collar is removed or removable from the container body. Preferably the engagement of the collar with the container body is by means of one or more retaining parts, for example as mentioned above (e.g. one or more recesses, protrusions, or a rim, of the container body).

In preferred embodiments of the invention, the collar (or other part) can engage with and/or can be secured to the container body independently of the cap. That is, preferably the collar does not require the action or the presence of the cap in order for the collar to be engaged with and/or secured to the container body. More preferably, the collar (or other part) has a relaxed and/or rest and/or default configuration in which its radial dimensions enable or ensure engagement and/or securement of the collar with the container body. For example, one or more flaps or other parts of the collar (or other part of the container) preferably have a relaxed configuration in which they provide a minimum inner diameter that is smaller than a maximum outer diameter of a part (preferably a retaining part) of the container body (preferably near to the opening of the container body). In a preferred arrangement, a first set of the flaps may have a relaxed configuration in which they provide a minimum inner diameter smaller than the maximum outer diameter of part of the container whereas a second set of the flaps have a relaxed configuration in which they provide a minimum inner diameter larger than the maximum outer diameter of said container part.

The cap is arranged so that, in the closed position, it prevents the flaps from moving radially outwards so they cannot disengage from the recesses (or other retaining parts(s)). However, in a preferred arrangement, the cap (and specifically the threadforms thereon) is shaped to press the flaps radially inwards as the cap is rotated to the closed position relative to the collar so as to force the flaps further into the recesses (or further into engagement with the retaining part(s)) and to positively hold them there. The flaps are thus tightly secured between the container and the cap by this camming action of the cap which urges the flaps radially inwards. Preferably, the cap is arranged to urge all of the flaps inwards in this manner even those, such as the first set referred to above, which are inclined inwards. The second set of flaps which are inclined outwards will, of course, also need to be urged inwards by the cap to engage them with the respective recesses (or other retaining part(s)).

When the cap is unthreaded, an action of the cap and/or an action of the container preferably forces (e.g. flexes) the flaps or other parts of the collar outwardly to enable the collar to be removed from the container body, although this may not be necessary for the second set of flaps as these may move outwards by their own resilience as they assume their relaxed, unthreaded position. Preferably the flaps or other parts of the collar are flexible, more preferably resiliently flexible.

For those embodiments of the invention in which movement of the cap with respect to the collar allows disengagement of the collar from the container body, this preferably is due to one or more features of the cap. For example, the cap may include one or more recesses in which one or more parts of the collar may be accommodated (e.g. following an initial movement of the cap with respect to the collar). Such recess (es) may allow outward movement (e.g. radially outward movement) of the part(s) of the collar with respect to the container body and consequently may allow disengagement of the collar from the container body. Advantageously, such recess or recesses of the cap may comprise part of a thread of the cap, e.g. as explained later in this specification.

For those embodiments of the invention in which movement of the cap and collar with respect to the container body causes disengagement of the collar from the container body, this preferably is due at least in part to one or more features on the container body. For example, one or more parts of the collar may ride up or over one or more features of the container body in the form of protrusions, ramps, ribs or walls provided on the exterior of the container body (e.g. on a container rim). Thus, for example, if a retaining part on the container body comprises an outwardly projecting rim of the container body, the collar may be disengaged from the container body by one or more parts of the collar riding up one or more ramps, causing the collar to clear the rim. Additionally or alternatively, for example, if one or more retaining parts on the container body comprise one or more recesses in an exterior surface of the container body, the collar may be disengaged from the container body by one or more parts of the collar riding up a wall or ramp of a corresponding recess in which the part is engaged, causing the part to exit the recess and thus causing the collar to disengage from the recess in the container body. The shape of the container thus drives the flaps outwards to disengage them from the recesses (or other retaining part(s)) in the manner of a cam as the collar is rotated relative to the container.

Once the parts of the collar have ridden up out of the respective recesses, it is desirable to reduce the risk of the parts accidentally re-engaging the recesses or an underside of a projecting rim. Accordingly, the surface onto which the parts of the collar ride up onto out of the recesses preferably has a tapered form such that its diameter reduces towards the open end of the container. Said parts of the collar (or at least some of them) are preferably arranged to assume a diameter smaller than that of said surface so they have a tendency to ride up the surface towards the smaller diameter end and thus facilitate disengagement of the collar from the container. In embodiments in which the collar parts engage recesses in the wall of the container body, the surface having the tapered form preferably is the external wall of the container body adjacent the opening. In embodiments in which the collar parts engage under a projecting rim or recesses within the rim, the surface having a tapering form preferably is the external surface of the rim leading to the container opening.

Advantageously, the invention may include the aforesaid feature(s) on the container body and the aforesaid features of the cap, e.g. functioning cooperatively. Thus, the feature(s) on the container body may cause part(s) of the collar to move outwardly, and the feature(s) of the cap may accommodate such outward movement of the part(s) of the collar, for example.

The collar may advantageously comprise a plurality of flaps or other parts arranged spaced-apart from each other along the circumferential extent of the collar.

Accordingly, a fifth aspect of the invention provides closure means for a beverage container, comprising a cap for closing the container, and a collar comprising a plurality of flaps or other parts arranged spaced-apart from each other along the circumferential extent thereof, the cap and the collar including cooperating securement means by which the cap may be secured to the collar.

Preferably the flaps or other parts of the collar are indirectly connected to each other by means of a ring portion of the collar to which the flaps or other parts are directly connected.

When the collar is attached to the container body with the container body upright and the opening uppermost, preferably the ring portion of the collar is the lowermost portion thereof, with the flaps or other parts extending substantially vertically therefrom. The flaps or other parts of the collar preferably include radially-inwardly projecting shoulders which preferably engage with the rim or other retaining part of the container body to retain the collar thereon.

In a preferred arrangement; the collar may have two sets of flaps, e.g. arranged alternately around the ring portion, a first set of flaps which naturally assume positions at a first radius and a second set of flaps which naturally assume positions at a second radius larger than the first radius. The first set of flaps may, for example, be inclined radially inwards by a few degrees relative to the ring and the second set of flaps inclined radially outwards by a few degrees relative to the ring. In an unstressed state, the first set of flaps is preferably arranged to engage the container and have to be resiliently flexed outwards to disengage them from the container whereas, in the unstressed state, the second set of flaps are arranged so they have to be resiliently flexed inwards to engage the container.

The cap is releasably securable to the container body via the collar, preferably by means of a threaded engagement with the collar. Consequently, the (or each) securement means of the collar and/or the cap preferably is a thread. The threaded engagement may comprise a screw-threaded engagement. Preferably, however, the threaded engagement is a bayonet-style engagement. The term "thread" as used herein includes (at least in the broadest aspects of the invention) continuous and discontinuous threads, (e.g. continuous and discontinuous screw threads), and bayonet-style threads, for example. Threads used in relation to the invention may, for example, comprise a plurality of segments (each thread segment comprising a said securement means), in which case the thread may be discontinuous (e.g. a discontinuous screw-thread or a bayonet-thread), or it may be substantially continuous because the effect is that of a substantially continuous screw-thread pattern.

A sixth aspect of the invention provides a beverage container comprising a container body including an opening and a cap to close the opening, the cap or the container body including one or more bayonet threads, and the container body or the cap respectively including one or more protrusions arranged to engage with a respective bayonet thread to secure the cap to the container body, at least one of the bayonet threads including one or more stop members arranged to retain the, or each, protrusion substantially fully engaged with the bayonet thread such that the opening is substantially fully closed by the cap, until a releasing torque sufficient to overcome the retention is applied to the container.

In some preferred embodiments of the sixth aspect of the invention, the beverage container includes a collar mountable on the container body, the collar including the bayonet thread or the one or more protrusions, such that the cap is secured to the container body by being secured to the collar when the collar is mounted on the container body.

Accordingly, a seventh aspect of the invention provides a beverage container comprising a container body including an opening, a cap to close the opening, and a collar mountable on the container body, the cap or the collar including one or more bayonet threads, and the collar or the cap respectively including one or more protrusions arranged to engage with a respective bayonet thread to secure the cap to the container body when the collar is mounted on the container, at least one of the bayonet threads including one or more stop members arranged to retain the, or each, protrusion substantially fully engaged with the bayonet thread such that the opening is substantially fully closed by the cap, until a releasing torque sufficient to overcome the retention is applied to the container.

The (or each) bayonet thread preferably comprises a substantially circumferentially-extending part and a substantially axially-extending part. The substantially circumferentially-extending part of the thread provides the securement (direct, or indirect via a collar) of the cap to the container body, by preventing axial movement between the cap and the container body; it may include a slight incline such that it extends over a small axial distance along its circumferential length. The substantially axially-extending part of the thread enables a protrusion engageable with the thread to become engaged therewith and/or disengaged therefrom. However, at least in some embodiments of the invention (as explained below) the bayonet thread may comprise only a substantially circumferentially-extending part, and may not include a substantially axially-extending part.

Preferably a plurality of bayonet threads is provided. Thus, the number of bayonet threads preferably is at least two, more preferably at least four, even more preferably at east six, e.g. eight or more. The bayonet threads preferably are substantially evenly spaced around the circumference of the cap, collar or container body.

The (or each) stop member of a bayonet thread may for example comprise a step, ledge, obstruction or projecting member of the bayonet thread over which a respective protrusion (engaged with the bayonet thread) must pass in order to disengage the protrusion from the bayonet thread. Most preferably, the (or each) stop member of the bayonet thread comprises a step between two axially differing levels of the bayonet thread (the axis being an axis of the circumferentially-extending thread, and being the same as the axis extending through the opening of the container body when the cap is secured to the container body).

For those embodiments of the invention in which the bayonet thread(s) of the invention is/are provided in a skirt of the cap, as described earlier in this specification, each bayonet thread preferably includes a radially-outwardly extending recess, for example for accommodating a radially-outward protrusion provided on the collar. The recess preferably is provided substantially at an end region in the disengaging direction, of the substantially circumferentially-extending part of the bayonet thread. That is, a protrusion on the collar preferably is able to extend into the recess when the cap and the collar are rotated with respect to each other as far as possible in the disengaging direction. Consequently, when the cap and the container body are in this rotational orientation with respect to each other, and the cap is lifted axially away from the container body, the collar preferably is removed from the container body together with the cap, by means of an outward flexing or movement of parts (e.g. flaps) of the collar accommodated by the recesses provided in the bayonet thread. It should be understood that for such embodiments of the invention, it is not always necessary for the bayonet thread to include an axially-extending part in addition to the generally circumferentially-extending part of the thread, because it may not be necessary for the cap to be separated from the collar.

Accordingly, an eighth aspect of the invention provides a beverage container comprising a container body including an opening, a cap to close the opening, and a collar mountable on the container body, the cap including one or more threads, and the collar including one or more protrusions arranged to engage with a respective thread to secure the cap to the container when the collar is mounted on the container body, the or each thread including a radially-outwardly extending recess to accommodate a protrusion engaged with the thread and to allow the collar to be removed from the container body with the cap.

The one or more threads of the cap preferably are bayonet threads, e.g. as described above.

It is to be understood that any feature of any aspect of the invention may be a feature of any other aspect of the invention.

In preferred arrangements, the threadform(s) on the cap provide two functions, first they provide securement of the cap to the collar in the axial direction and, secondly, they provide a camming action to urge the flaps of the collar radially inwards to engage the flaps securely against one or more retaining part(s) of the container body (e.g. recesses in the container body).

The opening of the container body may be a narrow-mouth opening, e.g. a bottle-type opening. Such an opening may have a diameter of less then 40 mm, for example. Conventional standard bottle mouth sizes include diameters of 28 mm and 38 mm, and the opening of the container body of some embodiments of the present invention may have such a diameter.

Alternatively, the opening of the container body may be a wide-mouth opening. By a "wide-mouth opening" is meant (at least in its broadest sense) an opening of a size suitable for a person to drink from the container in the same manner as from a drinks glass or similar drinking vessel. That is, in its broadest sense, the wide-mouth opening of the container (for embodiments of the invention having a wide-mouth opening) generally renders the container suitable as a drinking vessel from which a beverage supplied in the container may be conveniently drunk (in contrast to conventional narrow-necked bottles and ring-pull cans which generally are not regarded as comfortable drinking vessels). In practice, this requirement means that the diameter of the wide-mouth opening of the container will normally need to be at least 40 mm, preferably at least 45 mm, and more preferably at least 50 mm. Additionally, an excessively wide opening is generally difficult for the consumer to drink from, and thus the wide-mouth opening preferably has a diameter no greater than 150 mm, more preferably no greater than 100 mm, and especially no greater than 80 mm. A particularly preferred diameter range for the wide-mouth opening is 50 to 80 mm, and examples of particular preferred diameters include 53 mm and 63 mm.

The container body preferably has no thread or thread segments on its exterior. Consequently, the container body preferably is comfortable for a consumer to drink directly from the container body.

A wide variety of thread forms for securing the cap to the container body via the collar, is possible. As indicated at the beginning of this specification, at least some embodiments of the invention are intended for the storage and supply of carbonated and other sparkling drinks, for example beers, ciders, sparkling wines (including champagne), other fizzy alcoholic beverages, and non-alcoholic fizzy and sparkling beverages, including sparkling water and carbonated soft drinks. For such beverages, it is preferred for the engagement between the cap and the collar to include provision for gas venting upon partial removal of the cap from the container body, to prevent so-called "missiling" of the cap whereby the cap is violently ejected from the container body as the container is opened, by the gas pressure of the contents of the container.

Advantageously, therefore, the collar and the cap may include means, preferably engageable elements, to block or restrict removal of the cap from the collar beyond an intermediate position (between fully secured and fully released) when the cap is under an axial pressure in a direction emerging from the container body.

Preferably the cap, the collar and the container body are constructed and arranged to provide a vent for venting gas from the container body at least when the cap is in an intermediate position (between fully secured and fully released).

As mentioned above, the cap, the collar, and the container body preferably are configured such that removal of the cap from the container body causes or allows removal of the collar from the container body. In some of the simplest embodiments of the invention, removal of the cap from the container body merely allows removal of the collar from the container body. Such removal of the collar from the container body may comprise simply pulling the collar from the opposite end of the container body from the opening (and indeed, this might be achieved automatically by gravity, in some embodiments). Alternatively, a more positive act of removal of the collar may be required of the consumer, for example tearing the collar from the container body, e.g. by means of one or more frangible portions of the collar. Of course, where removal of the collar from the container body is not automatic, the consumer might opt to leave the collar in place. However, this is less preferred because an advantage of the collar is that its removal from the container body can leave the exterior of the container body free from threads, thus enhancing the experience of the consumer drinking directly from the container body.

In other embodiments of the invention, the removal of the cap from the container body may cause the removal of the collar from the container body. For example, the act of removing the cap from the container body may tear the collar (e.g. via one or more frangible portions of the collar). Additionally or alternatively, the act of removal of the cap from the container body may cause the collar to be removed from the container body together with the cap. That is, the collar may be removed from the container body together with the cap, for example as described above.

In some embodiments of the invention, the cap and/or the collar may include tamper-evident means (e.g. a tamper-evident band). Preferably the tamper-evident means is removed from the cap or the collar (respectively) by the act of removal of the cap from the container body. Advantageously, the tamper-evident means and/or the collar may include means to prevent the cap from accidentally unscrewing from the collar under the influence of pressurization within the container (e.g. due to a pressurized beverage held in the container).

Embodiments of the invention preferably include sealing means to seal the container. Such sealing means may comprise part of the cap and/or the container body and/or the collar and/or a separate component, for example. Preferred sealing means include sealing flanges and/or other sealing members, for example gaskets and the like. Another possible sealing member is a membrane seal, for example comprising a metal foil seal (e.g. formed from aluminium foil), which may optionally be provided with one or more polymer layers on one or both major surfaces thereof. The foil seal may provide an excellent gas barrier, for example. Advantageously, the use of a metal foil seal may enable the formation of a seal by induction heating, e.g. by bonding one or more polymer layers to the container body and/or to the cap. The foil seal or other membrane seal may be provided on the cap and/or the container body and/or the collar and/or separately.

The container and its components may be made from any suitable material, including metal and/or glass and/or polymer material. Polymer materials are generally preferred for the cap and the collar, especially polyolefins, e.g. polyethylene or polypropylene. The container body preferably is formed from glass or polymer material, especially a polyolefin, e.g. polyethylene terephthalate (PET). The polymeric components preferably are formed by moulding, especially injection moulding and/or blow moulding.

BRIEF DESCRIPTION OF THE DRAWINGS

Some preferred embodiments of the invention will now be described, by way of example, with reference to the accompanying drawings, of which.

DESCRIPTION OF PREFERRED EMBODIMENTS

Figure 1A:
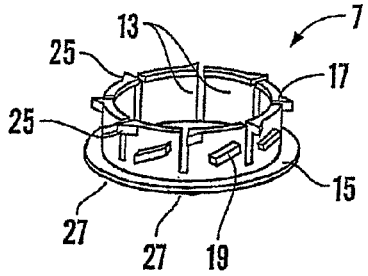
FIGS. 1 (*a*) and (*b*) are schematic illustrations of two similar embodiments of the invention.
Figure 1A:
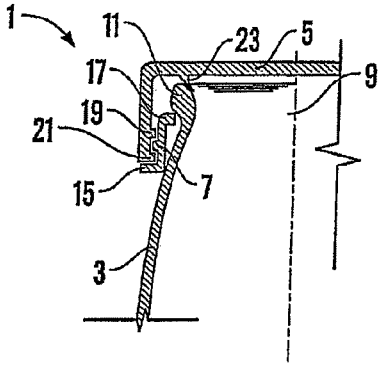
Figure 1B:
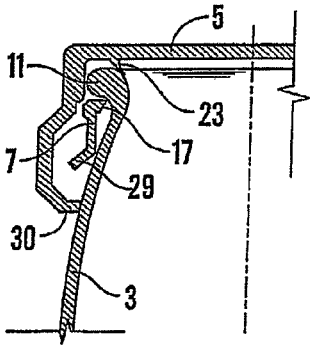
Figure 1B:
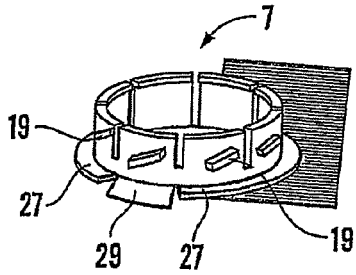

FIG. 1, views (*a*) and (*b*) show partial cross-sectional schematic views of a beverage container 1 according to the invention. The beverage container 1 comprises a container body 3, a cap 5 and a collar 7. The collar 7 is also shown separately in schematic perspective views.

As shown in the cross-sectional view of FIG. 1(*a*)(a) and FIG. 1(*a*)(b), when the cap 5 closes and seals a wide-mouth opening 9 of the container body 3, the cap is secured to the container body 3 by being secured to the collar 7, which is itself mounted on the container body. In particular, the collar 7 is trapped beneath a radially-outwardly projecting rim 11 of the container body adjacent to the wide-mouth opening 9. The collar 7 comprises a plurality of flaps 13 arranged spaced-apart from each other along the circumferential extent of the collar, and connected to each other by means of a ring portion 15 of the collar. As drawn, and as arranged in use with the wide-mouth opening 9 of the container body uppermost, the ring portion 15 of the collar is the lowermost portion thereof, with the flaps extending substantially vertically therefrom. In addition, the uppermost part of each flap includes a radially-inwardly projecting shoulder 17. The shoulders 17 of the flaps 13 of the collar engage with the rim 11 of the container body to trap the collar on the container body. The cap 5 is secured to the collar 7 by securement means in the form of inter-engaging threads or other protrusions 19 and 21 on the collar and the cap, respectively. Preferably the threads 19 and 21 are screw threads, but other forms of thread—e.g. bayonet threads—are possible.

In order to install the collar 7 onto the container body 3, the collar 7 is initially placed around the rim 11. This is possible because the internal diameter of the ring portion 15 and the main parts of the flaps 13 is greater than the external diameter of the rim 11. The collar 7 is then pressed down further onto the container body 3 such that the flaps 13 flex outwardly over the rim and are then trapped beneath the rim. This is possible because the flaps 13 are joined to each other only via the ring portion 15, enabling them to flex outwardly, and because the flaps are resilient, causing them to recover—or at least to attempt to recover—to their original configuration after being flexed over the rim 11. Once the collar 7 has been attached to the container body 3, it is then possible to secure the cap 5 to the collar, thereby closing and sealing the wide-mouth opening 9 of the container body. A variety of sealing mechanisms is possible. One possible sealing mechanism is shown in FIG. 1, whereby a flexible sealing flange 23 of the cap forms a sealing contact with an upper and inner part of the container body 3 at its wide-mouth opening 9, when the cap is fully secured to the collar 7. However, additional or alternative sealing mechanisms may be used. When the cap is fully secured to the collar 7, it prevents the flaps 13 from being able to flex radially outwards and so secures the flaps 13 beneath the rim 11. The cap preferably also urges the flaps 13 into secure engagement with the container.

In order to open the container, the cap 5 is removed from the collar 7 by unscrewing the cap from the collar. The collar 7 may be removed from the container body 3 by the act of removal of the cap from the collar, or the collar may be removed in a separate action. It is also generally possible for the collar to remain on the container body, but this is less preferred because an advantage of the collar is that its removal from the container body can leave the exterior of the container body adjacent to the wide-mouth free from threads, thus enhancing the experience of the consumer drinking directly from the container body. The embodiment of the collar 7 shown in view 1(*a*)(a) and 1(*a*)(b) includes a generally wedge-shaped projection 25 on the upper exterior periphery of each flap 13. These projections 25 may cooperate with one or more projections and/or recesses (not shown) on the interior of the cap 5 such that the act of unscrewing the cap 5 from the collar 7 causes one or more frangible portions 27 of the ring portion 15 of the collar, between adjacent flaps 13, to be torn, thus allowing removal of the collar 7 from the container body 3. The fact that the projections 25 are wedge-shaped enables the cap to be screwed onto the collar without tearing the collar.

The embodiment shown in FIGS. 1(*b*)(a) and 1(*b*)(b) has an alternative collar-removal feature. In this embodiment, at least one of the flaps 13 has a tab 29 with which a lowermost inwardly-projecting part 30 of the cap 5 may engage as the cap 5 is unscrewed from the collar 7. This engagement causes an adjacent frangible portion 27 of the collar 7 (between the flap in question and an adjacent flap) to be torn, thus enabling removal of the collar. Alternatively, the tab 29 may be gripped by the consumer once the cap has been removed, and an adjacent frangible portion 27 thereby torn, thus enabling removal of the collar.

Not shown in FIG. 1, but shown in FIG. 2 (which illustrates an alternative embodiment of the invention) are ribs 31 provided immediately below the rim 11 on the exterior of the container body 3. The ribs 31 are sized, shaped and arranged spaced-apart such that when the collar 7 butts against the underside of the rim 11 on the container body, the flaps 13 of the collar slot between respective ribs 31, thereby preventing rotation of the collar with respect to the container body. This enables the cap 5 to be screwed onto the collar 7, and unscrewed from the collar. (The ribs 31 are provided on the FIG. 1 embodiments of the invention, as well as on the FIG. 2 embodiment.) Any number of ribs may be provided on the container body, depending upon the number of flaps provided on the collar. Preferably there are four, six, eight or ten ribs arranged around the exterior of the container body. A small number (e.g. four or six) of ribs is preferred, thereby providing greater space between the ribs from which a consumer may drink a beverage directly from the container body.

Figure 2A:
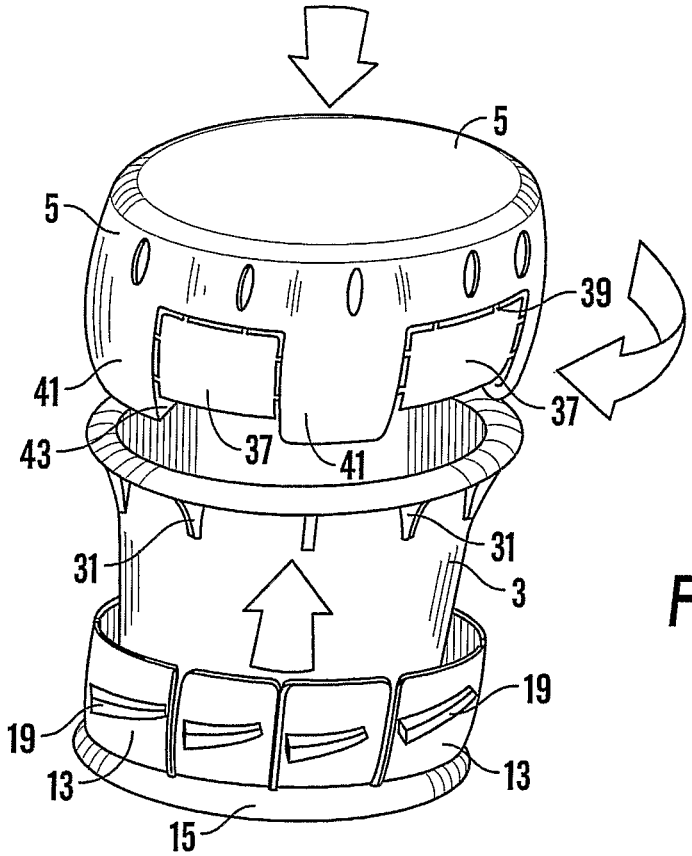
FIGS. 2 (*a*) and (*b*) are schematic illustrations of another embodiment of the invention.
Figure 2B:
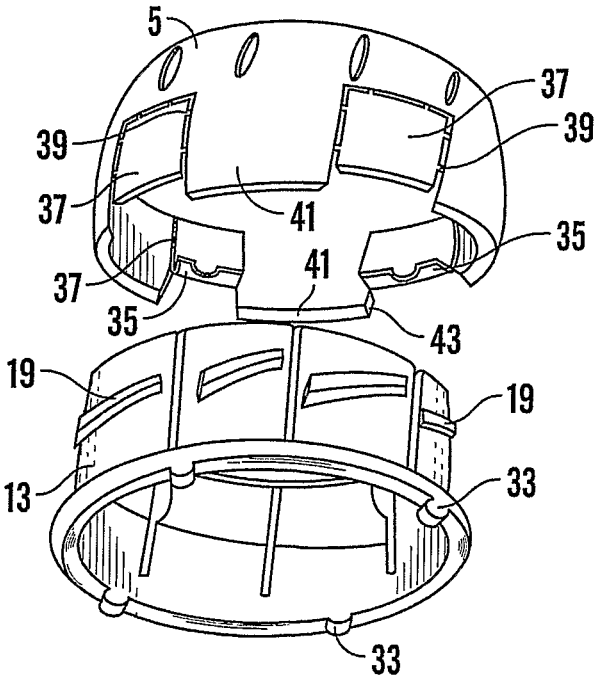

FIG. 2 (views (*a*) and (*b*)) shows an embodiment having a similar container body 3 and collar 7 to that shown in FIG. 1, but a different type of cap 5. The cap 5 includes a screw thread on its interior circumferential surface, but for clarity this is not shown. Thus, the cap 5 is screwed onto the collar 7, and unscrewed therefrom, in a manner similar to that for the FIG. 1 embodiment. Also, the collar 7 engages with ribs 31 on the underside of the rim 11 of the container body, similarly to the FIG. 1 embodiment. However, the FIG. 2 embodiment also includes means to prevent the cap accidentally unscrewing from the collar 7—consequently this embodiment is particularly suitable for use with carbonated (or otherwise sparkling) beverages, in which the interior of the container is pressurized. Such means comprise protrusions 33 provided on the underside of the ring portion 15 of the collar 7, with which inwardly projecting portions 35 of tamper-evident parts 37 of the cap engage, when the cap is fully screwed onto the collar 7 (and the cap fully closes the wide-mouth opening 9). In order to unscrew the cap 5, it is thus necessary for the consumer to exert sufficient unscrewing force to cause the tamper-evident parts 37 to be torn away from the remainder of the cap 5, via frangible webs 39 connecting the tamper-evident parts 37 to the remainder of the cap 5. In this way, the tamper-evident parts 37 not only provide an indication that the cap has been unscrewed, but also provide the means of preventing accidental unscrewing of the cap under the influence of the internal pressurization of the container when the container holds pressurized contents.

The cap 5 of the FIG. 2 embodiment also includes extension parts 41 which extend below the tamper-evident parts 37, and which also include inwardly projecting portions 43. The thread segments 19 on the collar and the thread segments (not shown) on the cap 5 preferably are configured such that when the cap is partially unscrewed from the collar 7 the thread segments on the cap can pass between respective thread segments 19 of the collar, thereby allowing the cap to lift slightly from the container body to allow some of the gas held in the container to vent to the atmosphere. In order to prevent the cap 5 from being forcibly ejected from the container body (known as "missiling" in the art), the inwardly projecting portions 43 of the extension parts 41 engage with the underside of the ring portion 15 of the collar, until continued unscrewing of the cap 5 by the consumer causes the extension parts 41 to flex outwardly, over the ring portion 15 (assisted by the protrusions 33, and also assisted by the fact that the tamper-evident parts 37 have by this stage been removed).

Figure 3A:
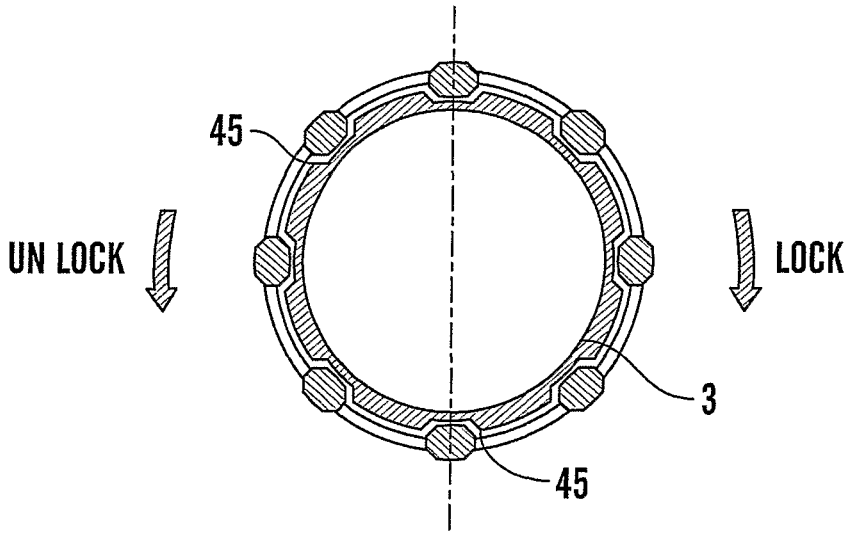
FIGS. 3 (*a*) and (*b*) are schematic illustrations of a further embodiment of the invention.
Figure 3B:
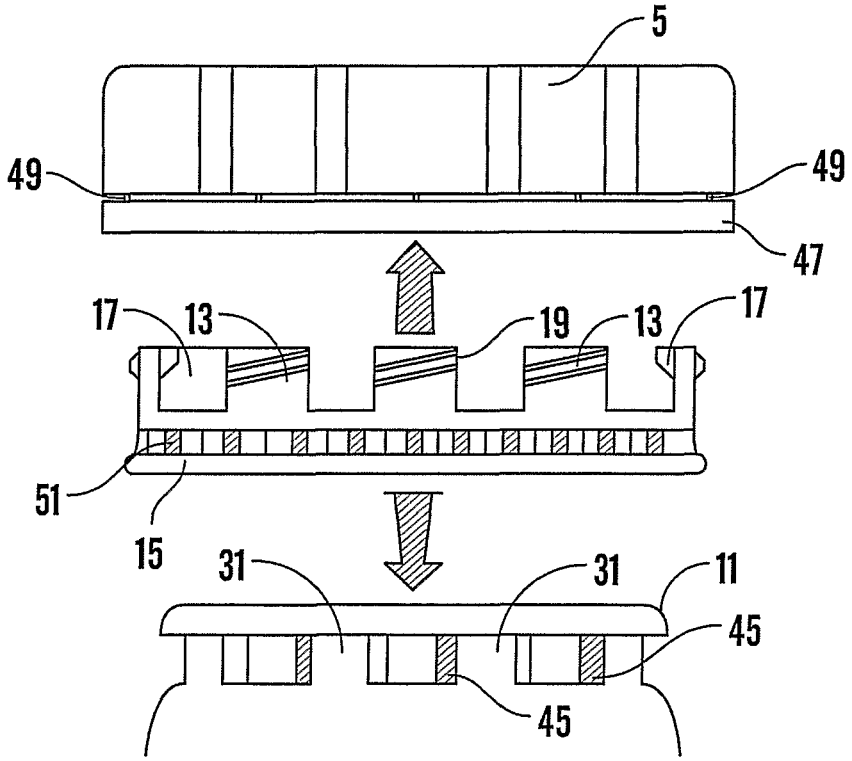

FIG. 3 (views (*a*) and (*b*) shows a further embodiment of the invention. In this embodiment, the flaps 13 of the collar 7 are spaced further apart than in the embodiments of FIGS. 1 and 2. Consequently, the ribs 31 on the container body are wider in extent than in those embodiments. Also, as with the previous embodiments, the flaps 13 include radially-inwardly projecting shoulders 17. Additionally, the left-hand circumferential edge 45 of each rib 31 is chamfered (ramped, i.e. inclined with respect to the radial orientation), whereas the right-hand circumferential edge 47 of each rib is substantially radial in orientation (substantially non-chamfered, i.e. substantially non-ramped). In this way, for right-hand screw threads on the collar 7 and cap 5, when the collar is located in position on the container body 3, it may be prevented from rotating clockwise (i.e. in the "screwing-on" direction) with respect to the container body, when the cap is screwed onto the collar. However, when the cap is unscrewed from the collar 7, once the cap has been partially released from the collar, the shoulders 17 of the flaps 13 are able to ride up the ramps 45 of the ribs 31, thus flexing the flaps 13 outwardly and releasing the collar 7 from the container body 3. (For left-hand screw threads, the positions of the ramped and non-ramped edges of the ribs 31 would, of course, be reversed.) The ramps 45 thus act as cams to drive the flaps 13 outwardly as the cap and collar are rotated relative to the container.

The cap 5 of the FIG. 3 embodiment also includes a tamper-evident band 47 which must be severed from the remainder of the cap 5 (by the tearing of frangible webs 49) in order to permit unscrewing of the cap from the collar 7. The tamper-evident band 47 is prevented from rotating with respect to the collar 7 by the inter-engagement of teeth (not shown) on the internal circumferential surface of the tamper-evident band and corresponding teeth 51 on the external circumferential surface of the collar 7.

Figure 4A:
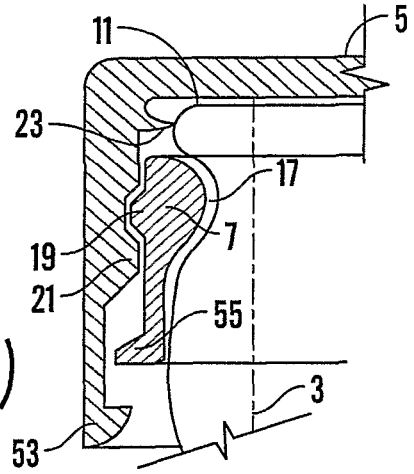
FIGS. 4 (*a*), (*b*) and (*c*) are schematic illustrations of an opening procedure of a still further embodiment of the invention.
Figure 4B:
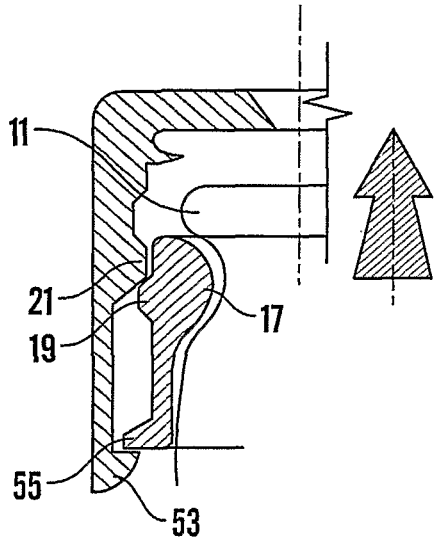
Figure 4C:
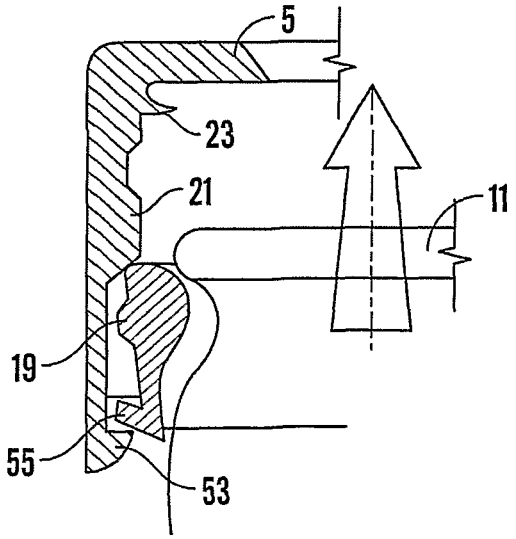

FIG. 4 views (*a*), (*b*) and (*c*) are schematic illustrations of an opening procedure of a still further embodiment of the invention. In this embodiment, the cap 5, collar 7 and container body 3 are similar to those of the other embodiments, with the cap 5 including thread segments 21 and a sealing flange 23, the collar 7 including an inwardly-projecting shoulder 17, and the container body 3 including an outwardly projecting rim 11. However, the collar 7 of this embodiment also includes a lowermost inwardly-projecting portion 53 that is arranged to engage with a corresponding lowermost outwardly-projecting portion 55 of the collar 7 when the cap is partially unscrewed from the collar 7, as shown in view (*b*), such that continued unscrewing of the cap forces the collar to be released from the container body as shown in view (*c*). Consequently, in this embodiment of the invention, removal of the cap from the container body causes the removal of the collar from the container body. More particularly, the cap 5 and the collar 7 are removed together from the container body, by the act of removal of the cap from the container body.

Figure 5:
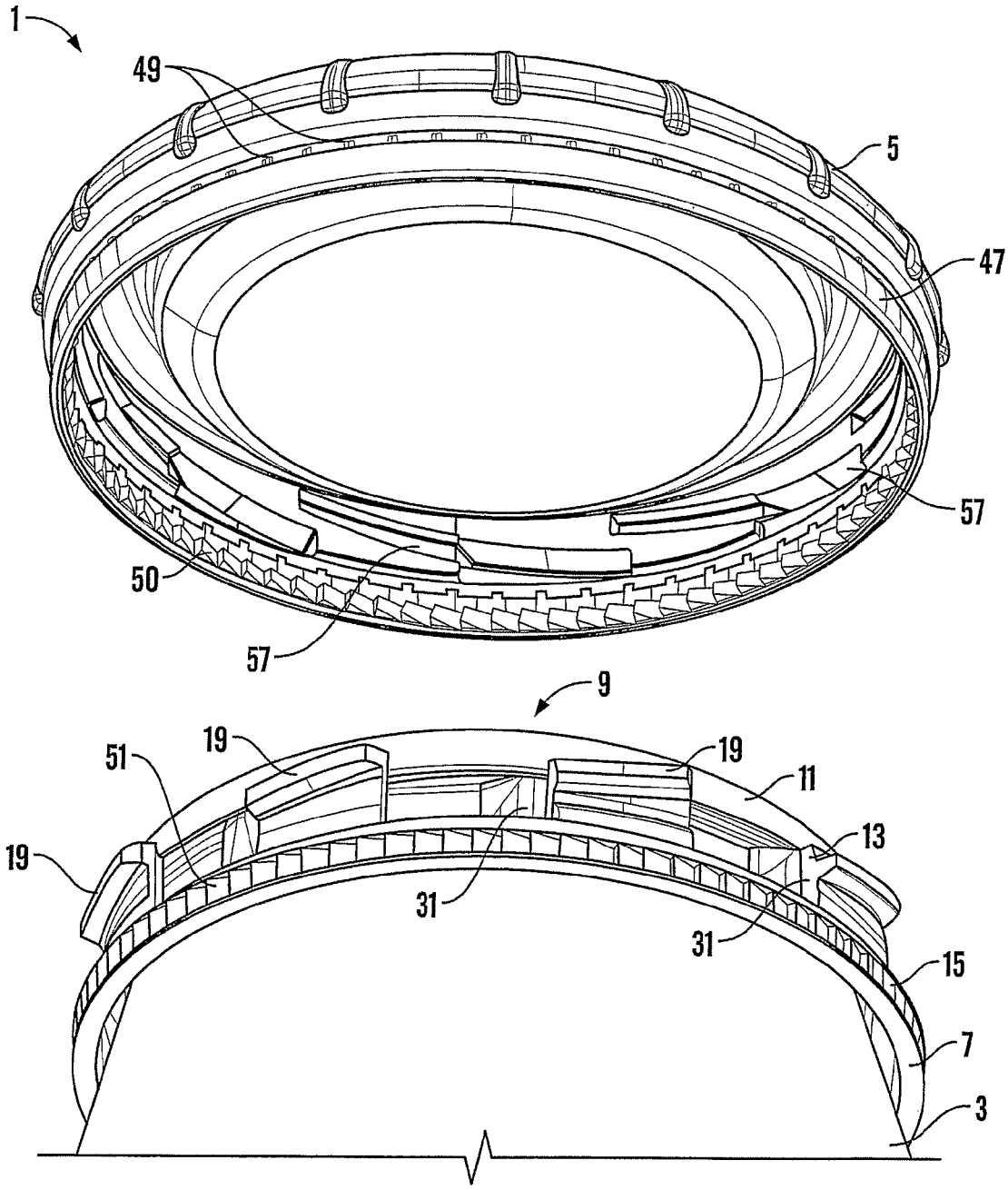
FIG. 5 is a detailed illustration of another embodiment of the invention.
Figure 8:
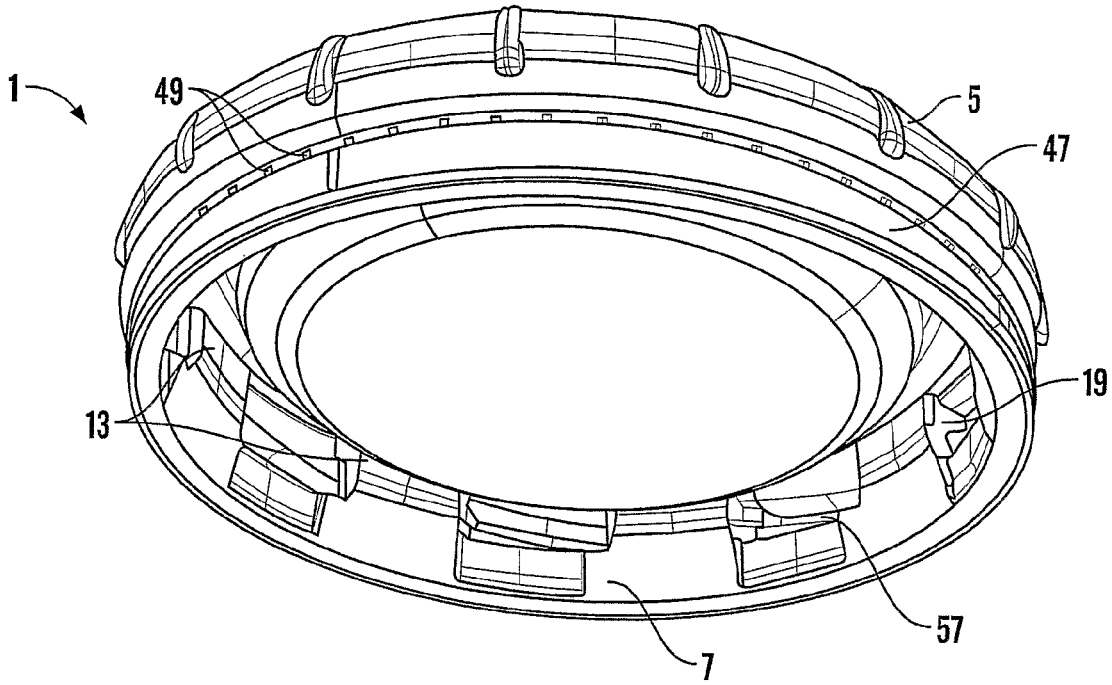
FIG. 8 is another illustration of the embodiment of the invention shown in FIGS. 5 to 7.
Figure 8:
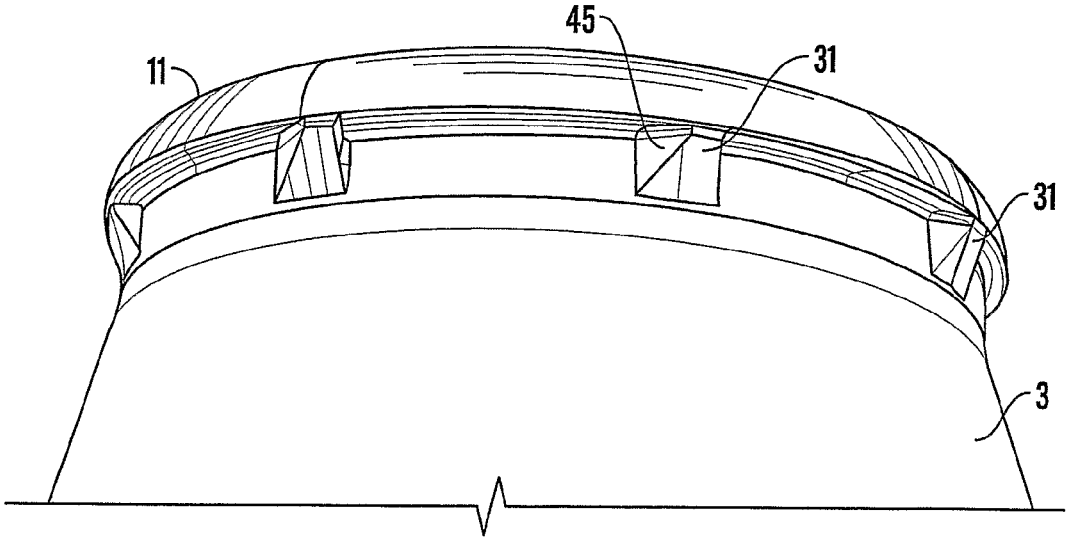
Figure 9:
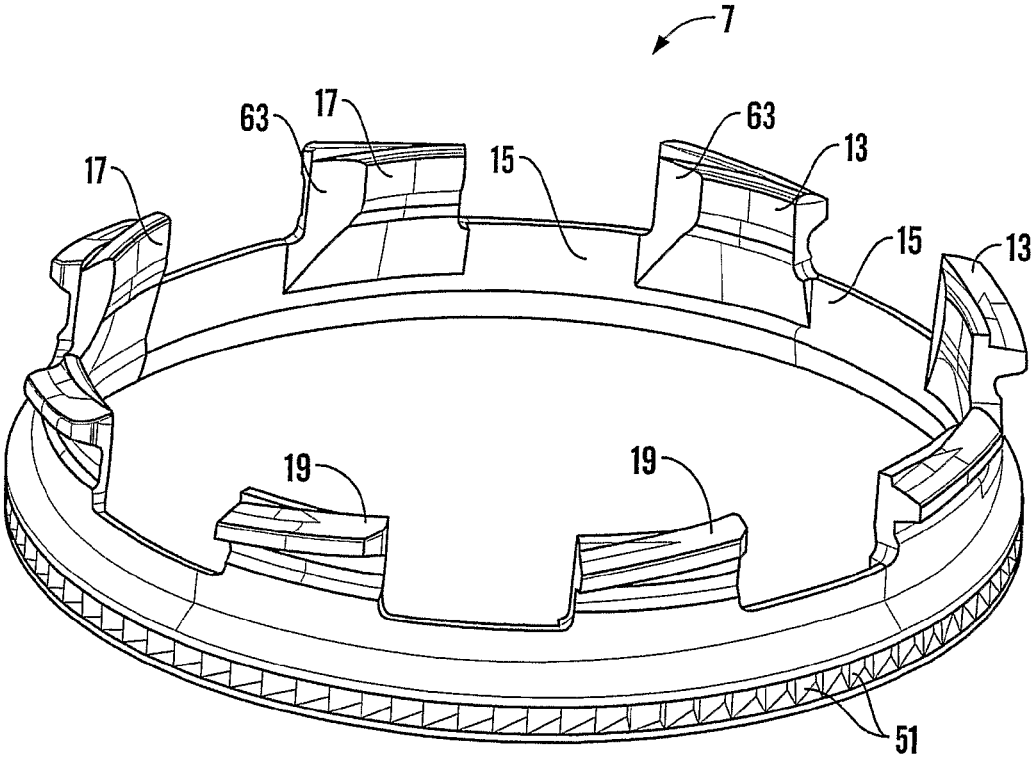
FIG. 9 is an illustration of an embodiment of a collar of the invention.

FIG. 5 shows an upper part of a container body 3 and a cap 5 of a beverage container 1 of another embodiment of the invention. Mounted on the container body 3 below a rim 11 around an opening 9 of the container body, is a collar 7. This collar 7 is also shown in FIG. 9; the cap is also shown in FIGS. 6 and 7; and the cap, collar and container body are again shown in FIG. 8.

The collar 7 comprises a plurality of flaps 13 arranged spaced-apart from each other along the circumferential extent of the collar, and connected to each other by means of a ring portion 15 of the collar. Each of the flaps 13 carries a radially-outwardly projecting thread or other protrusion 19, and a radially-inwardly projecting shoulder 17. Similarly to the FIG. 3 embodiment of the invention, the ring portion 15 carries teeth 51 on its external circumferential surface, which teeth are arranged to interlock with respective teeth 50 provided on the internal circumferential surface of a tamper-evident band 47 removably attached to the cap 5. The interlocking of the teeth 50 and 51 prevents the rotation of the cap with respect to the collar, until frangible webs 49 connecting the tamper-evident band to the cap 5 are broken, thereby providing tamper evidence.

Figure 6:
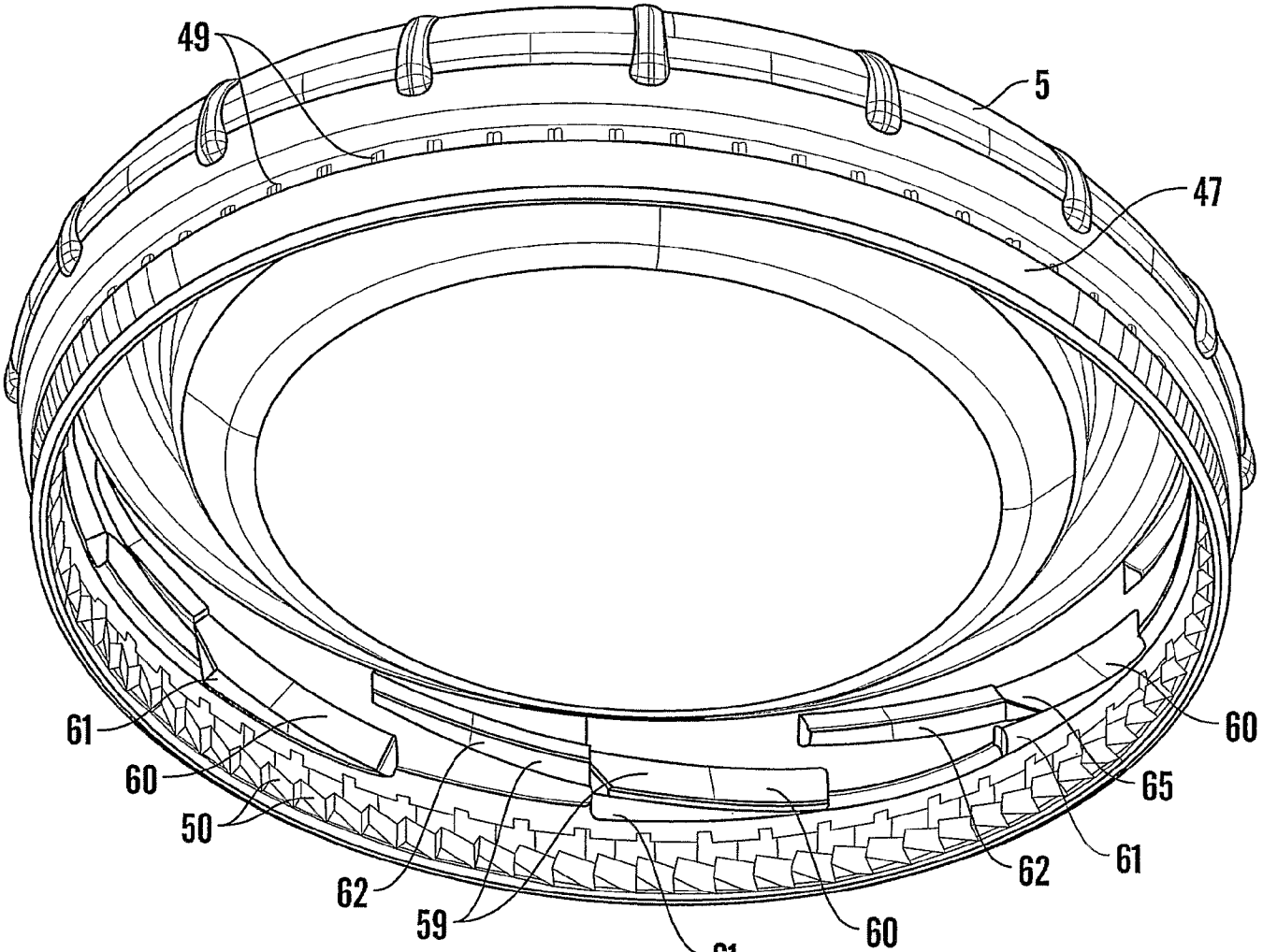
FIG. 6 is an illustration of a cap of the embodiment of the invention shown in FIG. 5.
Figure 7:
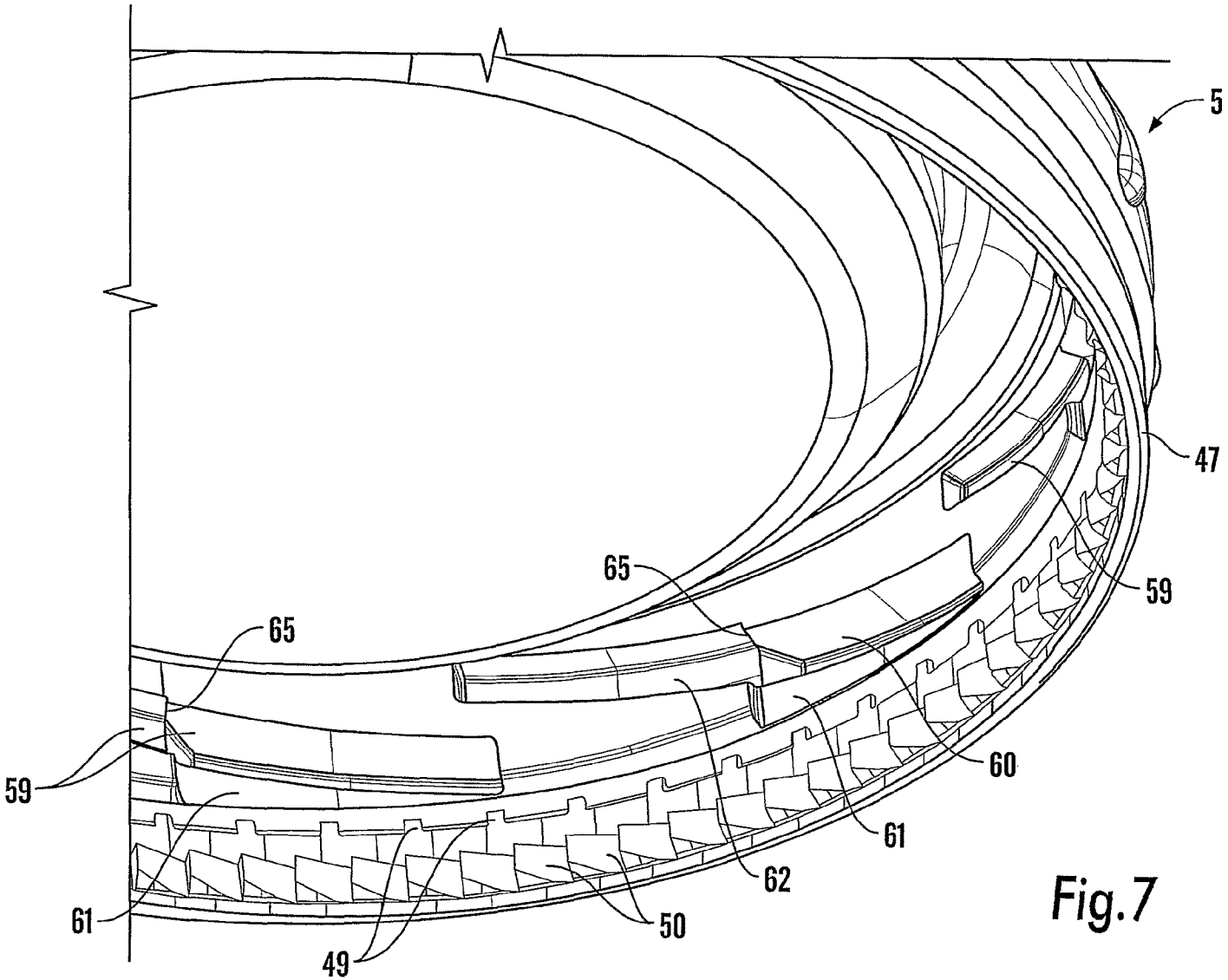
FIG. 7 is a detail of the cap of FIG. 6.

As shown in FIGS. 5 and 6, and in greater detail in FIG. 7, a radially-inwardly facing surface of a skirt portion of the cap 5 includes a plurality of bayonet threads 57 evenly spaced along the circumference of the cap. Each bayonet thread is arranged to receive a respective protrusion 19 of the collar 7 when the cap is secured to the container body. Each bayonet thread 57 comprises a substantially circumferentially-extending part 59 and a substantially axially-extending part 61. The substantially circumferentially-extending part 59 of the thread provides the securement of the cap to the collar, by preventing axial movement between the cap and the collar, and includes a slight incline so that when the cap is fully engaged with the collar it forms a tight seal with the container body. The substantially axially-extending part 61 of the thread enables the cap to be pushed axially onto the collar such that the protrusions 19 of the collar 7 engage with respective bayonet threads 57 of the cap.

At least in this embodiment of the invention, the cap may be engaged with the collar either before or after the collar is mounted on the container body. FIG. 8 shows the cap 5 and the collar 7 pre-assembled prior to being secured to the container body. However, if the cap is engaged with the collar when the collar is already mounted on the container body, preferably there is a tight fit between the axial part 61 of the bayonet threads 57 and the protrusions 19 requiring the cap to be "bumped" onto the container body/collar assembly with some force, otherwise when the collar is removed from the container body there would be a danger that the collar would not be removed together with the cap. (Such removal of the collar together with the cap is preferred in this embodiment of the invention, as explained below.) In any event, in this scenario the collar is mounted on the container body prior to engaging the cap with the collar, by firstly passing the ring portion 15 of the collar over the rim 11 of the opening 9 of the container body. This is possible because the inside diameter of the ring portion of the collar 7 is larger (by a small amount) than the outside diameter of the rim 11. As the collar is pushed down onto the container body 3, the flaps 13 of the collar flex outwardly, thereby allowing the radially-inwardly projecting shoulders 17 to pass over the rim. Once the shoulders 17 have cleared the rim 11, they are able to relax (at least partially) back from their outwardly flexed configuration, thereby trapping the collar 7 below the rim.

If the cap 5 is engaged with the collar 7 before the collar is mounted on the container body 3, the cap is pushed onto the collar such that initially the substantially axially-extending parts 61 of the bayonet threads 57 receive respective threads or protrusions 19 of the flaps 13 of the collar, and then the substantially circumferentially-extending parts 59 of the bayonet threads receive the protrusions. As can be seen in FIGS. 5 to 7, each bayonet thread 57 includes a radially-outwardly extending recess 60 situated in the circumferentially-extending part 59 above the axially-extending part 59. Each recess 60 enables a respective flap 13 of the collar 7 to flex outwardly as the cap and collar assembly is fitted over the rim 11 of the container body 3, thereby allowing the radially-inwardly projecting shoulders 17 to pass over the rim so that the cap and collar assembly can be mounted on the container body. Once the shoulders 17 have cleared the rim 11, they are able to relax (at least partially) back from their outwardly flexed configuration, thereby trapping the collar 7 below the rim.

Whether the cap 5 has been engaged with the collar 7 before or after the collar is mounted on the container body, initially, each thread or protrusion 19 of the collar 7 is accommodated in a relatively deep region (in a radial direction) of a respective bayonet thread 57 of the cap 5, namely in the recess 60. Then, in order fully to close the opening 9 of the container body by forming a tight seal between the cap 5 and the rim 11, the cap 5 is twisted in a clockwise direction (as drawn in the figures; an anti-clockwise thread may instead be used, of course). If the flaps 13 of the collar 7 are not already abutting respective ribs 31 provided spaced-apart around the outer circumference of the container body below the rim 11, the twisting the cap 5 will normally cause a partial rotation of the collar 7 with respect to the container body until the flaps do abut the ribs. The right-hand edge of each rib 31 provides a stop to prevent further rotation of the collar 7. Consequently, continued twisting of the cap 5 relative to the container body causes the cap to be tightened down onto the rim 11 of the container body, because the protrusions or threads 19 of the collar have effectively become threads of the container body. In particular, each thread or protrusion 19 of the collar 7 moves from the deep region of a bayonet thread 57 (i.e. a recess 60) to a shallower region of the bayonet thread (i.e. the region 62). Consequently, the flaps 13 of the collar 7 are tightened against the container body 3 by a camming or urging action caused by the interaction of the threads. The tamper-evident band 47 attached to the cap 5 is arranged such that its inwardly-facing teeth 50 engage with the outwardly-facing teeth 51 on the collar 7. In particular, the two sets of teeth are arranged as a ratchet, such that the outer teeth 50 are able to pass over the inner teeth 51 in the twisting-on direction (i.e. clockwise in the embodiment illustrated in the figures).

When the cap 5 is fully engaged with the collar 7, with the collar mounted on the container body 3 such that the cap is secured to the container body, each protrusion or thread 19 is located in an end region 62 in the twisting-on direction, of the circumferentially-extending part 59 of a respective bayonet thread 57. Each protrusion or thread 19 is retained in this location by a stop member 65 included in the bayonet thread. Each stop member 65 preferably comprises a step in its respective bayonet thread, between the region 62 and the region of the thread that includes the recess 60. In the embodiments of the invention illustrated in FIGS. 5 to 11, each stop member 65 is provided in an upper surface of the bayonet thread. However, a stop member could additionally or alternatively be provided in a lower surface and/or a side surface of the bayonet thread.

Removal of the cap and the collar is accomplished by twisting the cap anti-clockwise (in the embodiments of the invention as drawn) with respect to the container body, initially with a torque sufficient to overcome the engagement between each protrusion or thread 19 and its respective stop member 65. Such twisting of the cap 5 causes the cap to be rotated relative to the collar 7, and also causes the collar 7 to be rotated relative to the container body 3. Rotation of the cap 5 relative to the collar 7 causes the frangible webs 49 connecting the tamper-evident band 47 to the cap to be ruptured because the tamper-evident band is unable to rotate with the cap due to the ratchet teeth 50 and 51 being interlocked with each other. The precise order in which the relative rotations between the cap 5, the collar 7 and the container body 3 occur will depend upon the relative frictional forces and other forces between the various components. However, eventually the cap 5 will be rotated relative to the collar 7 such that each protrusion or thread 19 is located at an end of the circumferentially-extending part 59 of its respective bayonet thread 57, and the collar 7 will be rotated relative to the container body 3 such that each flap 13 abuts against a chamfered or ramped edge 45 of a respective rib 31. Continued twisting of the cap 5 relative to the container body 3 therefore causes the flaps 13 of the collar 7 to ride up the ramped edges 45 of the ribs 31, thus flexing the flaps outwardly into respective recesses 60 in the bayonet threads 57 and releasing the collar from the container body. In order further to assist the outward flexing of the flaps 13, their leading edges 63 in the releasing direction preferably are also chamfered or ramped. Consequently, the collar 7 is removed from the container body together with the cap 5, and the container is opened.

Figure 10:
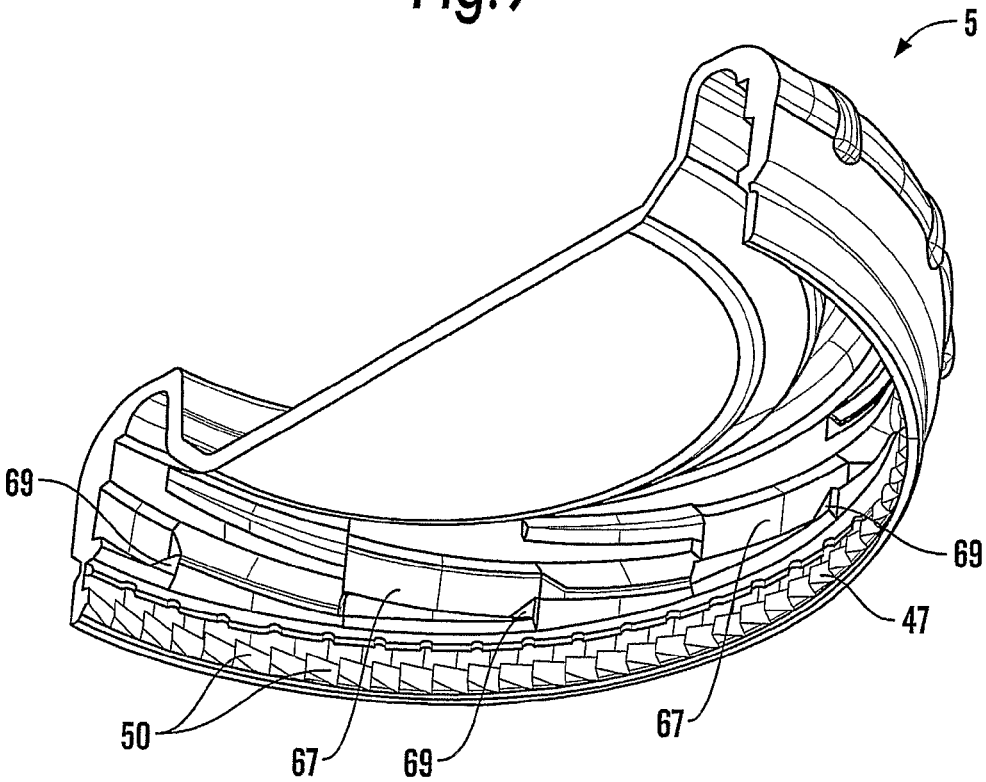
FIG. 10 is a cut-away illustration of a cap of a further embodiment of the invention.
Figure 11A:
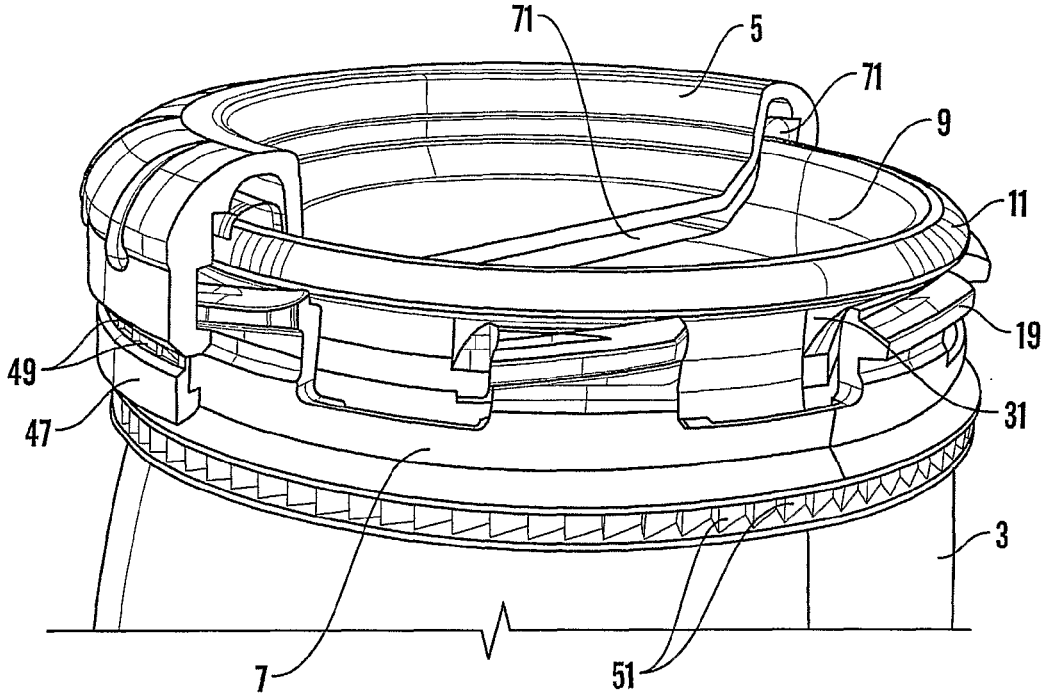
FIG. 11 shows two views of an embodiment of the invention including the collar of FIG. 9 and the cap of FIG. 10.
Figure 11B:
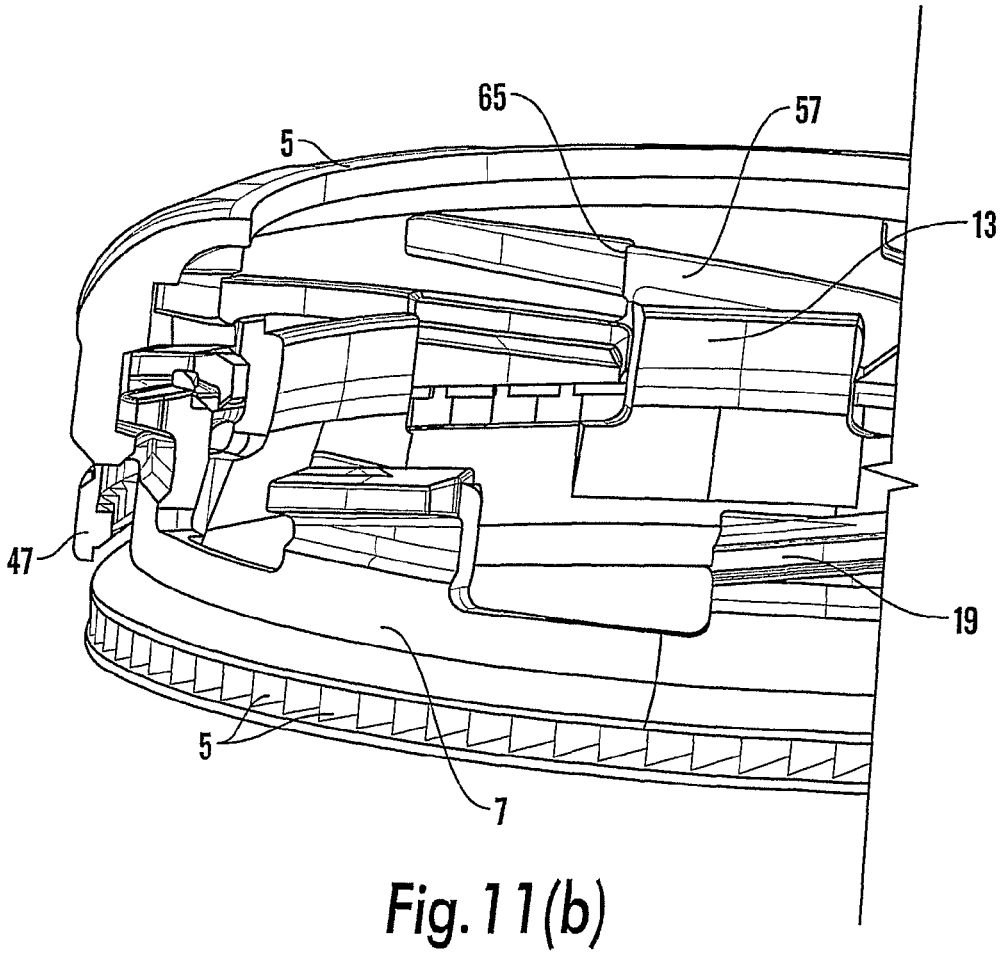

The embodiment of the invention shown in FIGS. 10 and 11 is identical to that shown in FIGS. 5 to 9, except that in FIGS. 10 and 11 each bayonet thread 57 of the cap 5 includes an additional region 67 of the circumferentially-extending part 59. The additional region 67 is situated between the opposite end regions 60 and 62 of the circumferentially-extending part 59, and provides a depression in the lower surface of the bayonet thread. The depression 67 is provided to facilitate gas venting from the container when the seal between the cap 5 and the container body is broken but before the cap is removed from the container body, in order to prevent "missiling" of the cap under the gas pressure of a carbonated or other fizzy beverage stored in the container. In particular, the depression 67 enables axial movement of the cap 5 away from the container body 3, thus increasing the gap created between the cap and the rim 11 to increase the speed of gas venting from the container. Additionally, an end wall 69 of each depression 67 in the releasing direction, provides a blocking element to block or restrict further rotation of the cap in the releasing direction until the gas has vented sufficiently to enable the consumer to press the cap back down towards the container body in order to enable the protrusions 19 to ride over respective end walls of the depressions. Continued rotation of the cap 5 relative to the container body 3 causes the protrusions to move into the end regions of the bayonet threads, thereby allowing the flaps 13 of the collar to flex outwardly into the recesses 60 as they ride up the ramps 45 of the ribs 31 of the collar. Although, as shown in FIGS. 10 and 11, the bayonet threads of the invention may include such depressions 67, for many embodiments of the invention they are unnecessary because there are sufficient gaps between the cap and the collar, and between the collar and the container body, to facilitate rapid gas venting when the seal between the cap and the container body is first broken.

FIG. 11(*a*) also shows a membrane seal 71 provided between the cap 5 and the container body 3, to form a seal between the cap 5 and the rim 11 when the cap is fully secured to the container body. The membrane seal preferably comprises metal foil (e.g. aluminium foil), preferably with a polymer layer on one or both major surfaces of the foil. Preferably the membrane seal 71 is bonded (e.g. thermally bonded) to the underside of the cap 5, but is not bonded to the container body 3 and instead forms a seal against the rim 11 due to the pressure between the cap and the rim. Consequently, when the cap 5 is lifted slightly from the rim 11 in the initial stage of opening the container 1, the seal between the rim and the cap is broken by the release of the pressure between the cap and the rim, and any pressurised gas in the container body may be vented to the atmosphere.

Figure 12A:
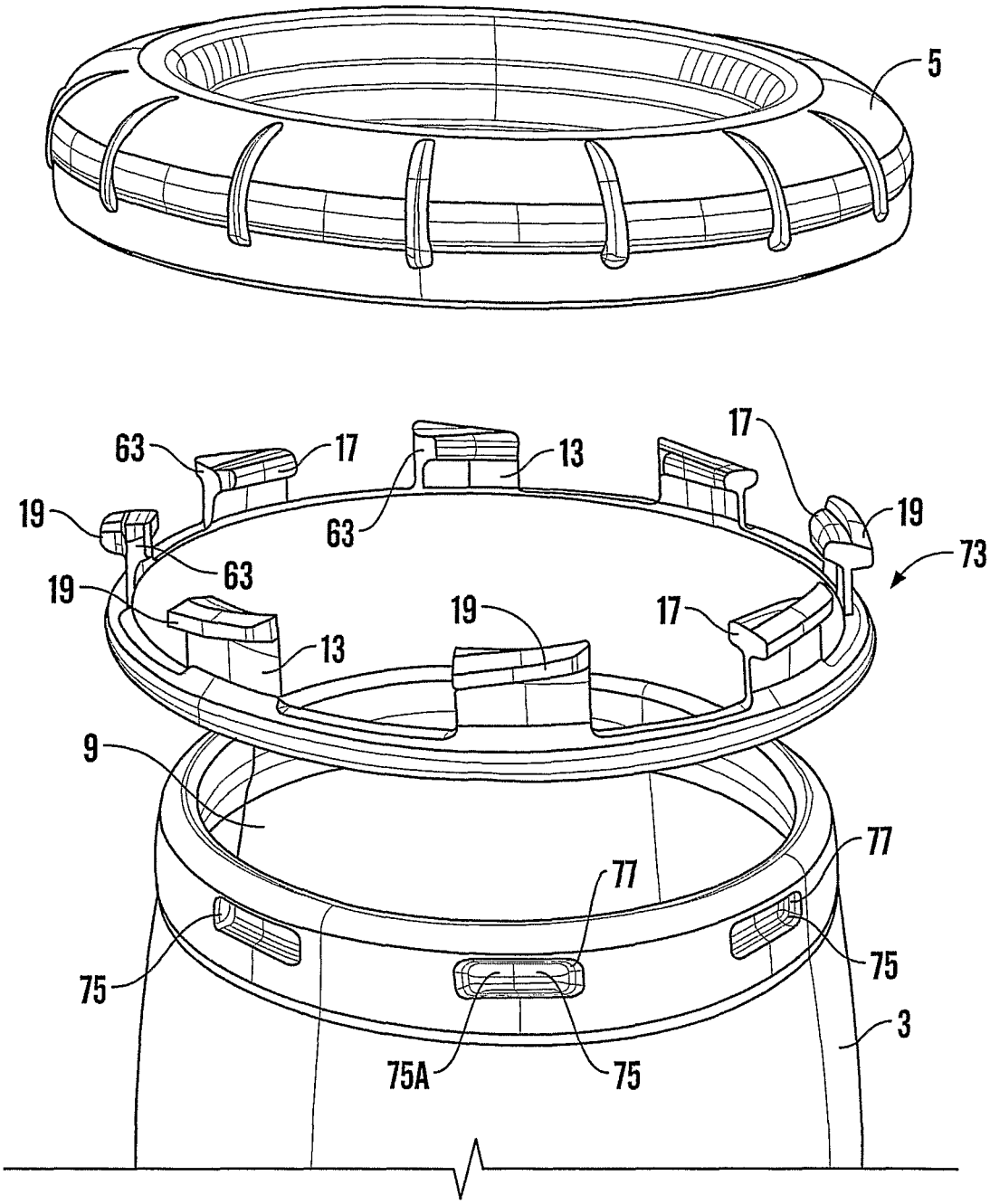
FIG. 12 (views (*a*) and (*b*)) shows two views of a further embodiment of the invention.

FIG. 12 (views (*a*) and (*b*)) shows a further embodiment of a beverage container according to the invention. This embodiment is similar to the embodiments shown in FIGS. 5 to 11 (and, for example, the thread of the cap may be the same as in any of those figures), but there are two main differences. Firstly, the embodiment of the invention shown in FIG. 12 does not include a tamper evident band, and thus the collar 73 does not include teeth 51. However, although a tamper evident band is not shown in FIG. 12, this embodiment of the invention can include a tamper evident band, and the collar 73 can include teeth 51, for example. Secondly, and more importantly, in this embodiment of the invention the retaining part(s) of the container body 3, which retains the collar engaged on the container body in use, instead of being an outwardly projecting rim 11, comprises a plurality of recesses 75 in the exterior surface of the container body 3. In particular, the recesses 75 are provided spaced-apart around the exterior circumference of the container body 3, below the opening 9. Other forms of recesses may also be used.

In use, when the cap 5 is secured to the container body 3 via the collar 73, the shoulder 17 of each flap 13 of the collar is located, in (and thereby engaged with) a respective recess 75 in the exterior of the container body, the shoulder 17 of each flap 13 being located beneath and engaging an upper surface 75A of the respective recess 75. The upper surfaces 75A provide the same function as the underside of the rim of the embodiments described above and are preferably substantially horizontal. As described above, rotation of the cap 5 relative to the collar 73 in the tightening direction then preferably drives the flaps 13, and hence the shoulders 17, into secure engagement with the recesses 75 and securely holds them in this arrangement until the cap is unscrewed.

As with above-described embodiments of the invention, in order to open the container, the cap 5 is rotated (i.e. unscrewed) with respect to the container body 3 and the collar 73 until each protrusion or thread 19 of the collar is situated at an end region (in the unscrewing direction) of the thread of the cap. Consequently, further rotation of the cap 5 with respect to the container body 3 forces the collar 73 to rotate together with the cap. This forces each shoulder 17 out of its respective recess 75, and this is possible because the protrusion or thread 19 of each flap 13 of the collar 73 is accommodated by a radially outwardly extending recess 60 of the thread of the cap, thus allowing each flap to flex outwardly. Such exiting of the shoulders 17 out of the recesses 75 is aided not only by the chamfered leading edge 63 (in the releasing direction) of each flap 13, but also by the end wall 77 (in the releasing direction) of each recess 75 being ramped (i.e. inclined).

Figure 12B:
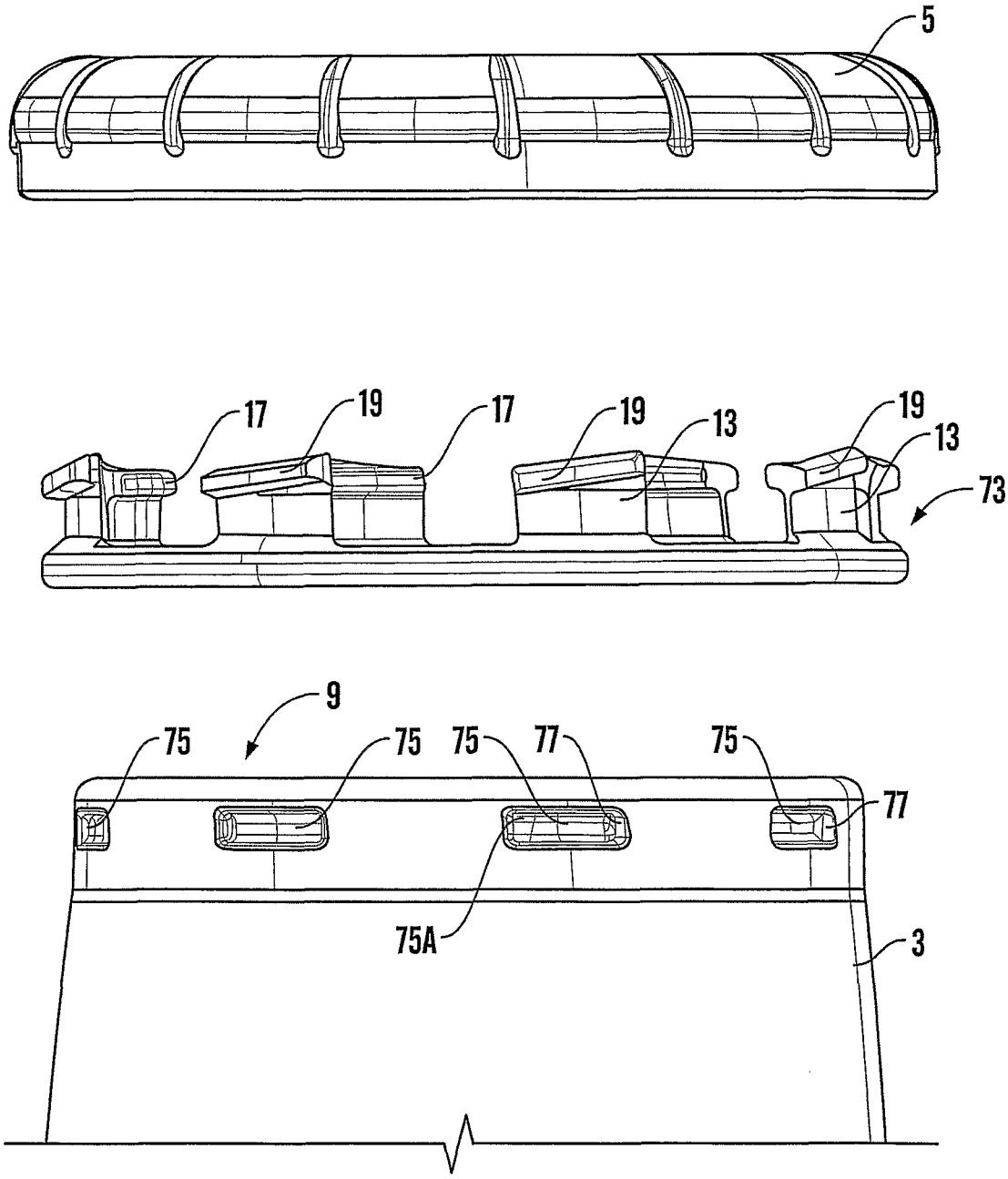

As shown in FIG. 12*b*, the external surface of the container body 3 has a tapering form in the region of the recesses 75 such that its diameter reduces towards the container opening 9. Once the shoulders 17 have exited the recesses 75 onto this surface, there is thus a natural tendency for the collar 73 to move upwards towards the opening as the flaps 13 try to assume their natural positions at a radius smaller than the external radius of the container body 3 in the area between the recesses 75. This tendency assists in disengaging the collar 73 from the container body 3.

The embodiment of the invention illustrated in FIG. 12 has the advantage that it does not include an outwardly projecting rim 11. (It can, if desired, include such a rim, but any such rim need not be large in size, and may be provided merely to aid drinking directly from the container body 3, for example.) Instead, the upper region of the container body 3 near to the opening 9 can be substantially clear of protrusions, and thus comfortable and convenient for a consumer to drink the beverage stored in the container, directly from the container body.

Figure 13A:
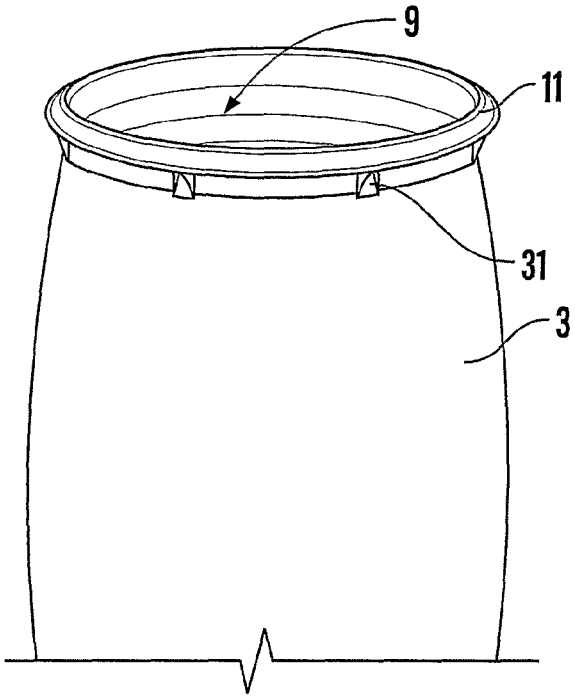
FIG. 13 shows three views of embodiments of containers according to the invention.
Figure 13B:
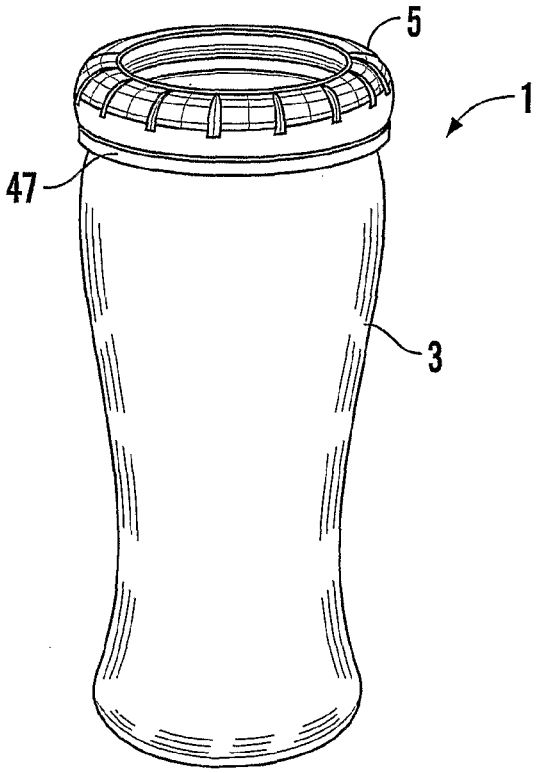
Figure 13C:
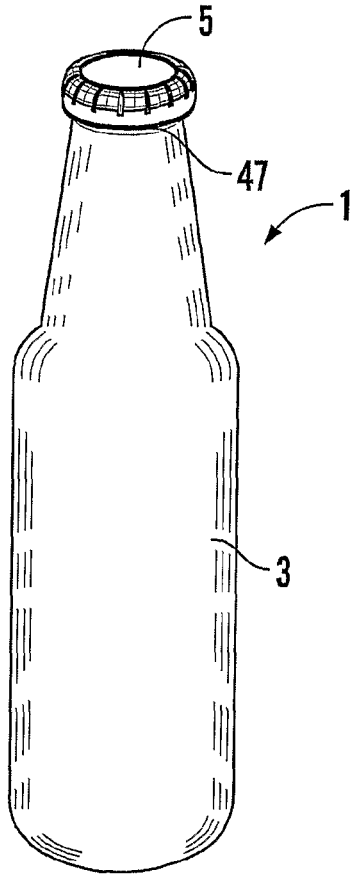

FIG. 13 shows views of two different embodiments of beverage container according to the invention. The container shown in views (*a*) and (*b*) is a wide-mouth container which has the form of a drinking vessel (e.g. a glass) once the cap 5 and the collar 7 are removed from the container body, as shown in view (*b*). The container shown in view (*c*) is a narrow-mouth container, in the form of a bottle.

Figure 14A:
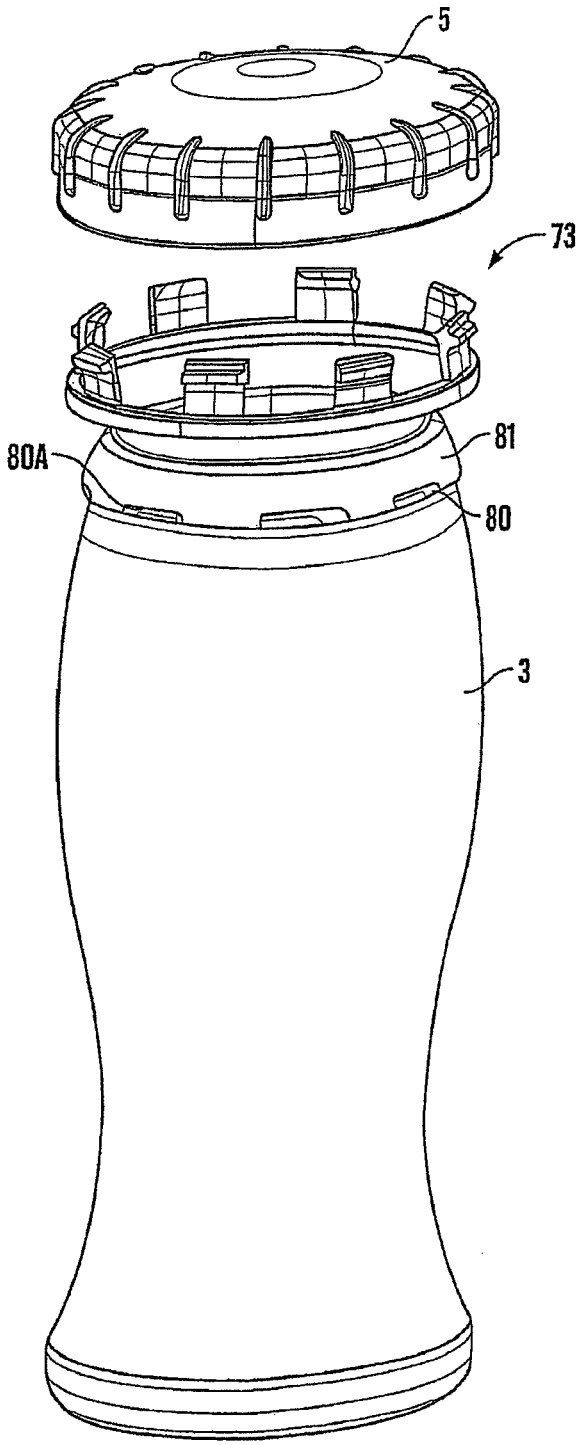
FIGS. 14*a* and 14*b* show perspective and front views, respectively, of another embodiment of the invention (showing a cap and collar prior to assembly with a container)
Figure 14:
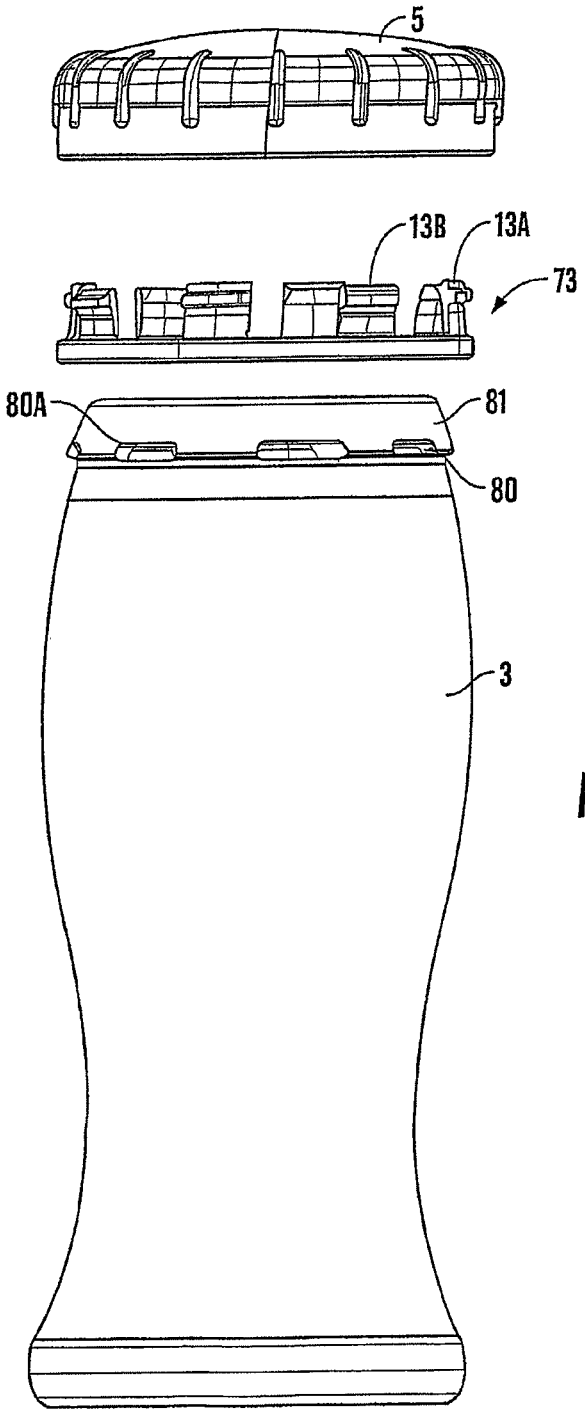
Figure 15A:
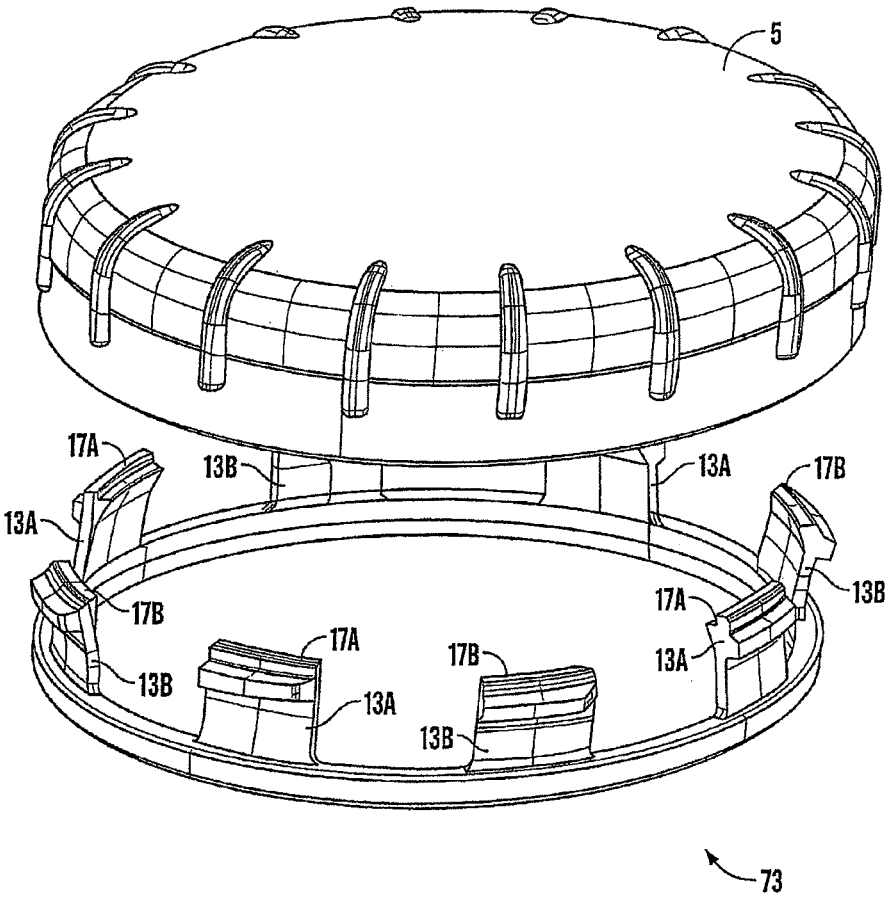
FIGS. 15*a* and 15*b* show enlarged, perspective views from above and below of the cap and collar shown in FIG. 14.
Figure 15:
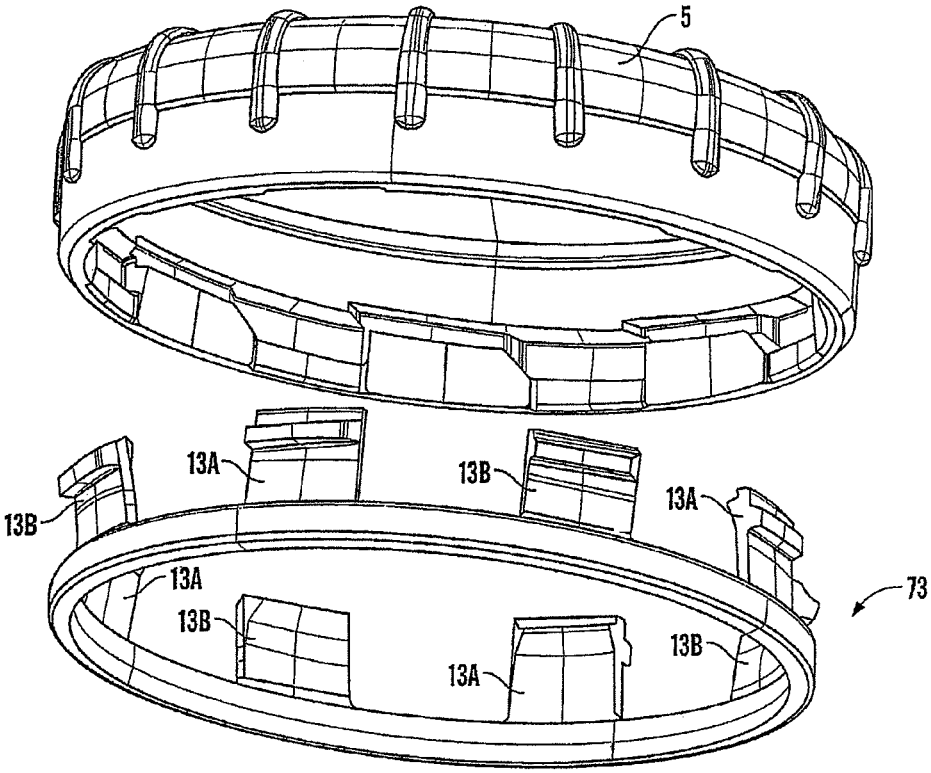
Figure 16:
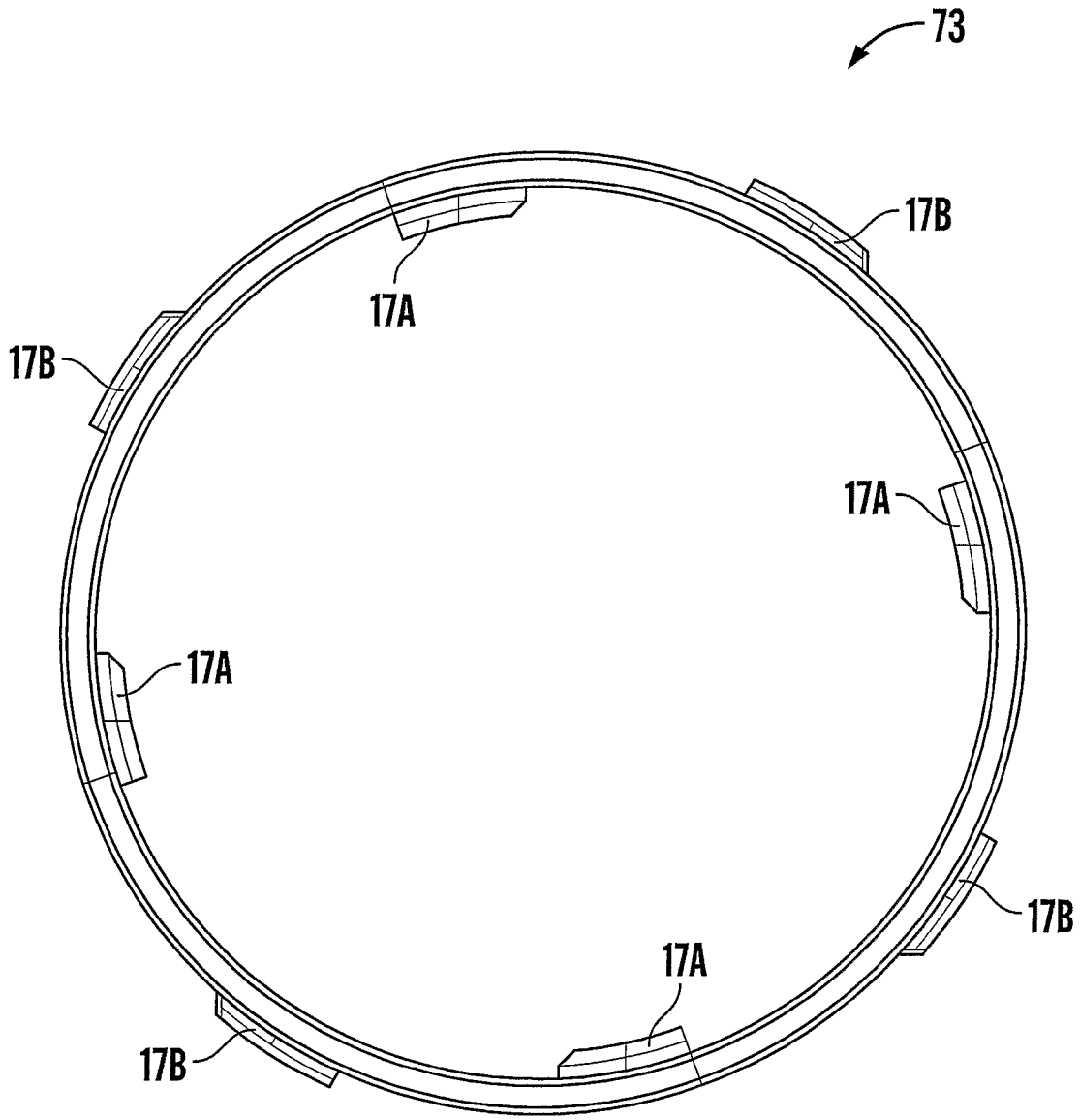
FIG. 16 shows a plan view of the collar shown in FIGS. 14 and 15.

FIGS. 14-16 show another embodiment of a beverage container according to the invention. This embodiment is similar to that shown in FIG. 12, and comprises a cap 5 and a collar 73 for forming a closure for a container body 3, but there are two main differences. Firstly, the embodiment shown in FIGS. 14-16 has a plurality of recesses 80 formed in the lower edge of a lip 81 of the container instead of the recesses 75 shown in FIG. 12. Secondly, whilst the collar 73 again has eight flaps 13, only four of these (13A) are orientated to engage with the recesses 80 as the collar is snap-fitted over the lip 81, the other four flaps (13B) are inclined radially outwards so their shoulders 17B do not, at least initially, engage with respective recesses 80 as the collar 73 is located over the lip 81. The plan view of FIG. 16 clearly shows a first set of four shoulders 17A positioned at a smaller radius than the second set of four shoulders 17B, the two sets of shoulders being arranged alternately around the circumference of the collar 73.

The provision of recesses 80 in the lip 81 of the container rather than in the side walls thereof (as in FIG. 12) is particularly suited to a container made of glass as the recesses do not then prejudice the strength of the container walls. Also, the lip 81 (with the recess 80) may typically be formed by injection moulding whereas the remainder of the container may typically be formed by blow moulding. A similar arrangement may, however, be used with a plastics container.

The four inwardly inclined flaps 13A enable the collar to snap-fit with the container as it is fitted over the container lip 80 (the collar 73 may need to be rotated until the flaps 13A align with and engage the respective recesses 80). These four flaps 13A thus also prevent rotation of the collar 73 relative to the container body 3 when the cap 5 is fitted to the collar 73.

When the cap 5 is fitted over the collar 73, it biases the four outwardly inclined flaps 13B to an inwardly inclined position so they also engage in respective recesses 80. The advantage of having four flaps 13B which naturally assume a slightly outwardly inclined position is that these flaps 13B provide a more secure connection between the cap 5 and the collar 73 when the cap is unscrewed for removal from the container body 3 as they spring outwards to engage the recesses provided in the cap. This helps ensure that the collar 73 is removed with the cap 5. It also helps reduce the risk of blow-off or missiling of the cap 5 when it is initially unscrewed to allow venting of the container 3.

In use, the collar 73 is preferably installed onto the container lip 81 on its own. It can be applied in a random orientation relative to the container (i.e. the flaps 13A, 13B do not need to be aligned with the recesses 80) as it can then be rotated a few degrees until flaps 13A align with and engage in recesses 80. The cap 5 is then fitted over the collar and rotated relative thereto so the thread portions of the cap and collar engage and the flaps 13B are driven into engagement with respective recesses 80 (if they are not already located therein). In the closed position, the cap 5 also preferably urges all the flaps 13A and 13B radially inwards to hold them securely in the respective recesses 80. As in earlier embodiments, once the cap is fully secured, it also prevents the flaps 13A from moving radially outwards so they cannot disengage from the recesses 80, the shoulders 17A and 17B engaging upper surfaces 80A of the recesses 30 (the upper surfaces 80A preferably being substantially horizontal).

To open the container, the cap is unscrewed relative to the container body 3 and the collar 73 until the thread portions of the collar 73 reach the end regions of the thread of the cap 5. Further rotation of the cap 5 with respect to the container body 3 forces the collar 73 to rotate together with the cap 5. This forces each of the shoulders 17A and 17B out of its respective recess 80, this being possible (as in earlier embodiments) because the thread portions of each flap 13A, 13B of the collar 73 is accommodated in a radially outwardly extending recess in the cap 5 so each flap 13A, 13B is able to move radially outwards although the collar is located within the skirt of the cap 5. Movement of the flaps 13A, 13B out of the recess 80 is aided by the leading edge of each flap 13A, 13B being chamfered and an end wall of each recess 80 engaged by this leading edge being ramped so as to drive the flap up onto the outer surface of the lip 81 in the manner of a cam. The outward movement of flaps 13A at this stage is against their natural tendency to assume an inwardly inclined position whereas the outward movement of the flaps 13B is back towards their natural outwardly inclined position.

An additional important feature is that lip 81 is tapered so that its external diameter decreases towards the open end of the container. Thus, once the flaps 13A, 13B have moved up onto the external surface of the lip, there is a tendency for the flaps 13A and 13B to ride up this inclined surface towards the open end of the container so helping disengage the closure from the container. This movement is assisted by flaps 13A which, once on the outer surface of the lip 81, try to assume their inwardly inclined position and so tend to slide up the inclined surface of the lip 81 to move radially inwards. This, therefore, facilitates removal of the closure from the container and helps reduce the risk of the flaps slipping downwards on the lip 81 and getting caught on the underside of the lip 81.

In each of the above embodiments, it will be appreciated that as the cap is moved to its secured position with the collar, the collar is drawn upwards to engage an upper surface of a recess (whether this be the underside of the rim or the upper surface of a slot or other form of recess) whilst the cap is drawn downwards to sealingly engage the mouth of the container (whether directly or via some form of intermediate sealing member). The cap and collar combination is thus tightened or clamped in a substantially vertical direction (i.e. parallel to the axis of the container opening) about a first surface provided by the upper surface of the container mouth and a second surface provided by the upper surface of said recesses.

It will be appreciated that features of the above-described embodiments may be interchanged to provide further embodiments of the invention.

The invention also relates to a cap and/or a collar for use in providing a beverage container as described herein. It also relates to a container body for use in providing such a beverage container.

The invention claimed is:

1. A beverage container comprising a container body including an opening, a cap to close the opening, and a collar mountable on the container body, the container body including a radially outwardly projecting rim beneath which the collar can be retained on the container body until removal of the cap, the collar comprising a plurality of flaps or other parts spaced-apart from each other along a circumferential extent of the collar, the cap and the collar including a plurality of circumferentially spaced thread parts by which the cap may be secured to the collar, thereby securing the cap to the container body when the collar is mounted on the container body, wherein the cap is shaped at a plurality of circumferentially spaced positions around its interior so as to press and/or hold said flaps or other parts of the collar by a camming action radially inwards as the cap is rotated relative to the collar so said flaps or other parts of the collar are secured beneath the rim of the container body, wherein the cap, the collar and the container body are configured such that removal of the cap from the container body causes removal of the collar from the container body, the container body having a plurality of spaced apart ribs beneath the outwardly projecting rim, one side of each rib having a ramp, whereby rotational movement of the collar in a loosening direction with respect to the container body causes each of said flaps to ride up a respective ramp so flexes the flaps outwardly to disengage them from said rim thereby releasing the collar from the container body.

2. A container according to claim 1, wherein an initial movement of the cap with respect to the collar allows a continued or subsequent movement of the cap to cause the cap and the collar both to move with respect to the container body.

3. A container according to claim 2, wherein the movement of the cap and the collar with respect to the container body causes or allows one or more flaps or other parts of the collar to move outwards with respect to the container body, thereby disengaging the collar from the container body.

4. A container according to claim 3, wherein the cap includes one or more radially-outwardly extending recesses to accommodate the outward movement of the one or more flaps or other parts of the collar.

5. A container according to claim 1, wherein the flaps or other parts are indirectly connected to each other by means of a ring portion of the collar to which the flaps or other parts are directly connected.

6. A container according to claim 5, wherein, in use, when the collar is attached to the container body with the container body upright and the opening uppermost, the ring portion of the collar is substantially the lowermost portion thereof, with the flaps or other parts extending substantially vertically therefrom.

7. A container according to claim 1, wherein the flaps or other parts include radially-inwardly projecting shoulders which beneath said rim of the container body to retain the collar thereon.

8. A beverage container comprising a container body including an opening, a cap to close the opening, and a collar mountable on the container body, the container body including one or more retaining parts by which the collar can be retained on the container body until removal of the cap, the collar comprising a plurality of flaps or other parts spaced-apart from each other along a circumferential extent of the collar, the cap and the collar including a plurality of circumferentially spaced thread parts by which the cap may be secured to the collar, thereby securing the cap to the container body when the collar is mounted on the container body, wherein the cap is shaped at a plurality of circumferentially spaced positions around its interior so as to press said flaps or other parts of the collar by a camming action radially inwards as the cap is rotated relative to the collar so said flaps or other parts of the collar are secured to the container body, wherein the cap, the collar and the container body are configured such that removal of the cap from the container body causes removal of the collar from the container body;

wherein the collar comprises two sets of flaps or other parts, a first set in which the flaps or other parts naturally assume positions at a first radius, and a second set in which the flaps or other parts naturally assume positions at a second radius larger than the first radius.

9. A container according to claim 8, wherein, in an unstressed state, the flaps or other parts of the first set are arranged to engage the container and are required to be flexed outwards to disengage them from the container, and the flaps or other parts of the second set are arranged so that they are required to be flexed inwards to engage the container.

10. A container according to claim 1, wherein the thread parts are a screw thread or a bayonet-style thread.

11. A container according to claim 1, wherein the thread parts are a screw thread or a bayonet-style thread, and wherein each thread of the collar is carried by a respective flap or other part of the collar.

12. A container according to claim 1, wherein the collar includes one or more radially-outwardly protruding threads arranged to engage with a respective thread of the cap, the or each thread of the cap including a radially-outwardly extending recess to accommodate a respective thread of the collar and to allow the collar to be removed from the container body with the cap.

13. A container according to claim 1, wherein the container body is substantially free from exterior threads.

14. A container according to claim 1, further comprising a seal covering the opening of the container body.

15. A beverage container comprising a container body including an opening, a cap to close the opening, and a collar mountable on the container body, the container body including one or more retaining parts by which the collar can be retained on the container body until removal of the cap, the collar comprising a plurality of flaps or other parts spaced-apart from each other along a circumferential extent of the collar, the cap and the collar including a plurality of circumferentially spaced thread parts by which the cap may be secured to the collar, thereby securing the cap to the container body when the collar is mounted on the container body, wherein the cap is shaped at a plurality of circumferentially spaced positions around its interior so as to press said flaps or other parts of the collar by a camming action radially inwards as the cap is rotated relative to the collar so said flaps or other parts of the collar are secured to the container body, wherein the cap, the collar and the container body are configured such that removal of the cap from the container body causes removal of the collar from the container body;

the container further comprising a seal covering the opening of the container body;

wherein the seal comprises part of the cap.

16. A container for use with an outer component and inner component, the container comprising a container body, the container body including a radially outwardly projecting rim, the inner component comprising a ring portion and a plurality of extending parts spaced-apart from each other and extending from the ring portion, the outer component and the inner component including a plurality of thread parts by which the outer component may be secured to the inner component, thereby securing the outer component to the container body when the inner component is secured to the container body, wherein the outer component is shaped at a plurality of spaced positions around its interior so as to engage said extending parts of the inner component as the outer component is rotated relative to the inner component so the extending parts of the inner component are engaged beneath said rim of the container body, the container body having a plurality of spaced apart ribs beneath the outwardly projecting rim, one side of each rib having a ramp, whereby rotational movement of the collar with respect to the container body causes each of said extending parts to ride up a respective ramp to disengage them from said rim thereby releasing the inner component from the container body.

17. A container according to claim 16, wherein the container is a beverage container, wherein the plurality of thread parts of the outer component are formed as bayonet threads, wherein the inner component is a collar which has a plurality of extending parts made of flaps, wherein the outer component is a cap which is secured to the container when the collar is mounted on the container body, and wherein the cap is shaped at a plurality of spaced positions around its interior so as to engage said parts of the collar as the cap is rotated in a counter clockwise direction relative to the collar.

18. A cap and collar for use as a closure for a container, the collar comprising a plurality of flaps arranged on the collar, the cap and the collar including cooperating protrusions by which the cap may be secured to the collar, the cap being shaped at a plurality of circumferentially spaced positions around its interior so as to press and/or hold said flaps of the collar radially inwards as the cap is rotated relative to the collar so as to secure the cap to the container.

* * * * *